United States Patent [19]

Kato et al.

[11] Patent Number: 5,056,941

[45] Date of Patent: Oct. 15, 1991

[54] PRINT HEAD ASSEMBLY OF A PRINTING DEVICE

[75] Inventors: Shigeki Kato, Chiryu; Yoshihumi Suzuki, Ena; Yasuji Chikaoka, Aichi; Miyuki Morimoto, Mie; Hiroyuki Watanabe; Noriyuki Yoneyana, both of Nagoya, all of Japan

[73] Assignee: Brother Kogyo Kabushiki Kaisha, Nagoya, Japan

[21] Appl. No.: 389,371

[22] Filed: Aug. 3, 1989

Related U.S. Application Data

[63] Continuation-in-part of Ser. No. 326,429, Mar. 20, 1989, Pat. No. 4,944,615, which is a continuation of Ser. No. 35,677, Apr. 7, 1987, abandoned.

[30] Foreign Application Priority Data

| | | | |
|---|---|---|---|
| Apr. 7, 1986 | [JP] | Japan | 61-79586 |
| Apr. 24, 1986 | [JP] | Japan | 61-42946 |
| Aug. 6, 1988 | [JP] | Japan | 63-196434 |
| Aug. 6, 1988 | [JP] | Japan | 63-196435 |

[51] Int. Cl.[5] ..... B41J 2/24

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,692,043 | 9/1987 | Ando et al. | 400/124 |
| 4,792,247 | 12/1988 | Sakaida et al. | 400/124 |

FOREIGN PATENT DOCUMENTS

| | | | |
|---|---|---|---|
| 194870 | 11/1984 | Japan | 400/124 |
| 10465 | 1/1986 | Japan | 400/124 |
| 49855 | 3/1986 | Japan | 400/124 |
| 76376 | 4/1986 | Japan | 400/124 |

*Primary Examiner*—David A. Wiecking

*Attorney, Agent, or Firm*—Jones, Tullar & Cooper

[57] ABSTRACT

A print head assembly of a printing device, in which a supporting member flexibly supporting a plurality of armature members, and a permanent magnet member urging the armatures in one direction by means of its magnetic force and arranged between a head body as a yoke member, including plurality of cores wound individually with solenoid coils, and a cover member integrally formed with a guide member having a nose for guiding a number of print wires. All these members are joined together along an assembling axis. The cover member has apertures individually formed at positions corresponding to the armature members, the armature members being secured to the supporting member by irradiation of an electron beam or a laser beam from the outside through the apertures.

17 Claims, 20 Drawing Sheets

PRINT HEAD ASSEMBLY OF A PRINTING DEVICE

RELATED APPLICATION

The present invention is a continuation-in-part of the invention disclosed and claimed in copending application, Ser. No. 07/326,429 filed Mar. 20, 1989, now U.S. Pat. No. 4,944,615, which in turn is a continuation of application, Ser. No. 07/035,677 filed Apr. 17, 1987, now abandoned.

BACKGROUND OF THE INVENTION

The present invention relates to a print head assembly of a printing device, such as a typewriter, printer, or the like, in which armatures are swung by energizing coils, whereby print wires connected to the armatures are moved to a printing position for printing operation.

In a specific configuration of the print head assembly of this type, the armatures are pulled toward cores by means of the magnetic force of a permanent magnet, thereby accumulating an urging force in a resilient member, and holding the print wires in their rest position. When the coils are energized, a magnetic path formed by the permanent magnet is canceled so that the print wires are moved to the printing position by the urging force of the resilient member.

In order to increase the density of arrangement within a limited space, in the case of the aforementioned conventional configuration, a plurality of cores, each wound with a solenoid coil, are arranged in a circular ring, and a ring-shaped yoke member is disposed around the cores. Further, a ring-shaped permanent magnet is attached to the yoke member, thus forming a substantially columnar head.

Examples of such a prior art print head are disclosed in U.S. Pat. Nos. 4,225,250; 4,348,120; 4,411,538; and 4,618,277.

In general, in the prior art print head assembly constructed in this manner, various members are joined together, along an axis, between a head body and a guide member. The head body has a yoke, while the guide member has a nose for guiding the print wires. The joined members include the permanent magnet, a supporting member for swingably supporting the armatures, a spacer, a spring member opposed to the permanent magnet, etc. In order to align these members along the assembling axis, for example, the head body may be formed with positioning pins which are adapted to be fitted in holes in the supporting member or the spacer. Alternatively, the members may be joined together by separate fixing means, such as bolts penetrating them along the assembling axis.

Conventionally, in assembling the print head assembly of the aforementioned type, the armatures are previously mounted on a resilient member, formed of a spring material, for example, thereby forming an armature unit. After the armature unit is attached to the nose of the guide member, the print wires are inserted individually into holes in the respective tip ends of the armatures, and into a guide portion of the nose. Then, the armatures and the print wires are fixed together by brazing or laser welding.

According to such a conventional method of assembling, however, the print wires and the armatures are fixed inside the head body. Therefore, a space for the fixing work must be kept between the tip ends of each two adjacent armatures.

As a result, the assembling work is troublesome and time-consuming, thus entailing an increased manufacturing cost.

With the prior art method of assembling as described above, since the armature is secured to the leaf spring, a swing of the armature causes a strain in the leaf spring, hereby storing strain energy. At this time, unless the secured end of the leaf spring is firmly and reliably clamped by spacer a and front yoke, the leaf spring is liable to operate unstably, resulting in defective print dot characteristics such as irregularities thereof caused by temperature variations and reduction in the accuracy of the print dot position.

SUMMARY OF THE INVENTION

The present invention is intended to settle the aforementioned problems of the prior art print head assembly, and has as an object to provide a print head assembly of a printing device in which components can be easily assembled and aligned, and manufactured at low cost.

In order to achieve the above object/according to the invention, electron beam or laser beam welding is adopted as a means for fixing to one another a plurality of armature members and a supporting member supporting these armature members for swinging. The energy for welding is supplied from the outside through aperture means, such as through holes or the like, toward the supporting member and armature members to be fixed to one another to a cover member covering the armature members.

Therefore, the assembling work need not be performed in a narrow space inside the print head. Thus, the assembling efficiency can be improved, and hence, the manufacturing cost can be reduced.

In a preferred print head assembly and also a preferred method of assembly to produce the same according to the invention, the cover member is formed with other aperture means, through which welding energy is supplied to members to be assembled together, for instance a supporting member consisting of a leaf spring member, a front yoke and a spacer, whereby an assembly unit is formed. The print head assembly can be readily assembled by assembling the unit between a rear yoke and guide means.

The securement end of the leaf spring is reliably clampedly secured between the front yoke and spacer. Therefore, although the leaf spring member is strained with swinging of the armature members, since the securement end is reliably secured, the leaf spring member is reliably operable to reduce defectiveness of characteristics such as print dot density irregularities and eliminates reduction of the print dot position accuracy.

A further preferred print head assembly according to the invention comprises a rear yoke having cores with coils wound thereon, armature members supported by resilient portions of a leaf spring member as a supporting member such as to be moved toward and away from the cores, a front yoke disposed in close proximity to the armature members and a spacer co-operating with the front yoke to clamp the securement end of the leaf spring, a magnetic path being formed by and extending through the cores, armature members, front yoke and rear yoke. In a further preferred method of assembly to produce a print head assembly , the spacer is formed in its portion corresponding to the securement end of the leaf spring with through holes, the spacer, securement end of the leaf spring member and front yoke are welded together by irradiating a welding beam through the through holes, and the leaf spring member and armature members are welded together by irradiating a welding beam on the side of the leaf spring member, on which the spacer is found.

Since the spacer has holes formed in its portion welded to the securement end of the leaf spring member, the welding beam is directly projected onto the leaf spring member in the securement end thereof. Thus, by setting the focus of the welding beam with respect to the irradiated surface of the leaf spring member, the securement end of the leaf spring member and resilient portions can be welded under the same welding conditions.

Where use is made of welding energy or welding beams, more specifically where welding with a welding beam, for instance an electron beam or a laser beam, is utilized for fixing the resilient portions of leaf spring members and armature members of a dot print head assembly and also for fixing the spacer, securement end of the leaf spring member and front yoke, it is desired to perform the welding under the same conditions for continuously welding together the resilient portions of the leaf spring member and securement end thereof. However, in the case of welding of the securement end of the leaf spring member the thickness of the weldment is different from the case of welding the resilient portions because of the presence of the spacer in the former case. Therefore, if the focus of the electron beam, i.e., the distance from the point, from which the beam is projected, to the irradiated portion, is set with respect to the resilient portions, the beam is out of focus in the securement end. Conversely, if the focus is set with respect to the securement end, the beam is out of focus at the resilient portions. In either case, the beam energy can not be sufficiently utilized. Further, if the beam energy is sufficiently increased to increase the welding depth of a section, in which three parts, i.e., spacer, securement end of leaf spring member and front yoke, are overlapped, the width of the surface of the weldment is also increased to increase the thermal influence. If the resilient portions of the leaf spring member are welded in this case, their resiliency is liable to be spoiled.

In order to prevent this, the securement end of the leaf spring member is provided with through holes, and a welding beam is projected through these through holes, as described above.

With this arrangement according to the invention, an area where the leaf spring member intervenes between the front yoke and spacer is substantially under the same welding conditions with respect to irradiation of the welding beam as an area where the leaf spring member and an armature member are overlapped. Further, compared to the prior art arrangement for welding of the spacer without provision of any through hole, a sufficient welding depth can be obtained, while at the same time the surface bead is reduced and the range where there is thermal influence on the leaf spring member is reduced. Thus, it is possible to prevent troubles of the dot print head assembly due to breakage of the leaf spring member.

In a further preferred print head assembly and a further preferred method of assembly to produce the same, when a leaf spring member and an armature member, for instance, of the print head assembly are fixed together by a welding process using an electron beam or a laser beam, a first member to be welded to a second member is formed on its back surface opposite the second member with a recess, and the first and second members are welded together by irradiating an electron beam or a laser beam from the side of the opening of the recess, thus securing together the two members.

With this arrangement, the portion of the first member to be welded is reduced in thickness by the provision of the recess, from the opening side of which an electron beam or a laser beam is projected. Therefore, where a leaf spring member and an armature member are the respective first and second members to be welded together, if welding is performed to provide a sufficient mechanical strength of the bond between the recess of the leaf spring member and the armature member, the spread of the bead width in the welded portion of the leaf spring member having a reduced thickness can be suppressed to the spread of the portion which is thermally influenced.

It is thus possible to prevent portions other than the welded portion from becoming fragile while ensuring sufficient mechanical strength of the weldment.

The thickness of a leaf spring member, for instance, as a member to be welded to armature members, is set by taking its mechanical strength into consideration. Therefore, if it is intended to obtain sufficient mechanical strength, the width of the weldment, i.e., bead width, is increased, increasing the thermal influence, particularly on parts near the weldment, for instance, torsion bar portions and curved arm portions. This may cause the torsion bar portions and curved arm portions to become fragile.

On the other hand, if it is arranged to reduce the bead width so as to minimize the thermal influence on the welded portions or members, the mechanical strength of the weldment is liable to be insufficient.

These problems set forth above can be solved by the preferred arrangements of the present invention.

The above and other objects and advantages of the present invention will become more apparent and will be better understood with reference to the following detailed description of the preferred embodiments of the invention taken in conjunction with the accompanying drawings.

BRIEF DESCRIPTION OF THE DRAWINGS

FIG. 21(*b*) is a graph showing a hardness distribution in the weldment shown in FIG. 21(*a*);

FIGS. 22(*b*) and 23(*b*) are views similar to FIG. 21(*b*) but showing hardness distributions in weldments shown in FIGS. 22(*a*) and 23(*a*), respectively.

DETAILED DESCRIPTION OF THE PREFERRED EMBODIMENTS

Figure 1:
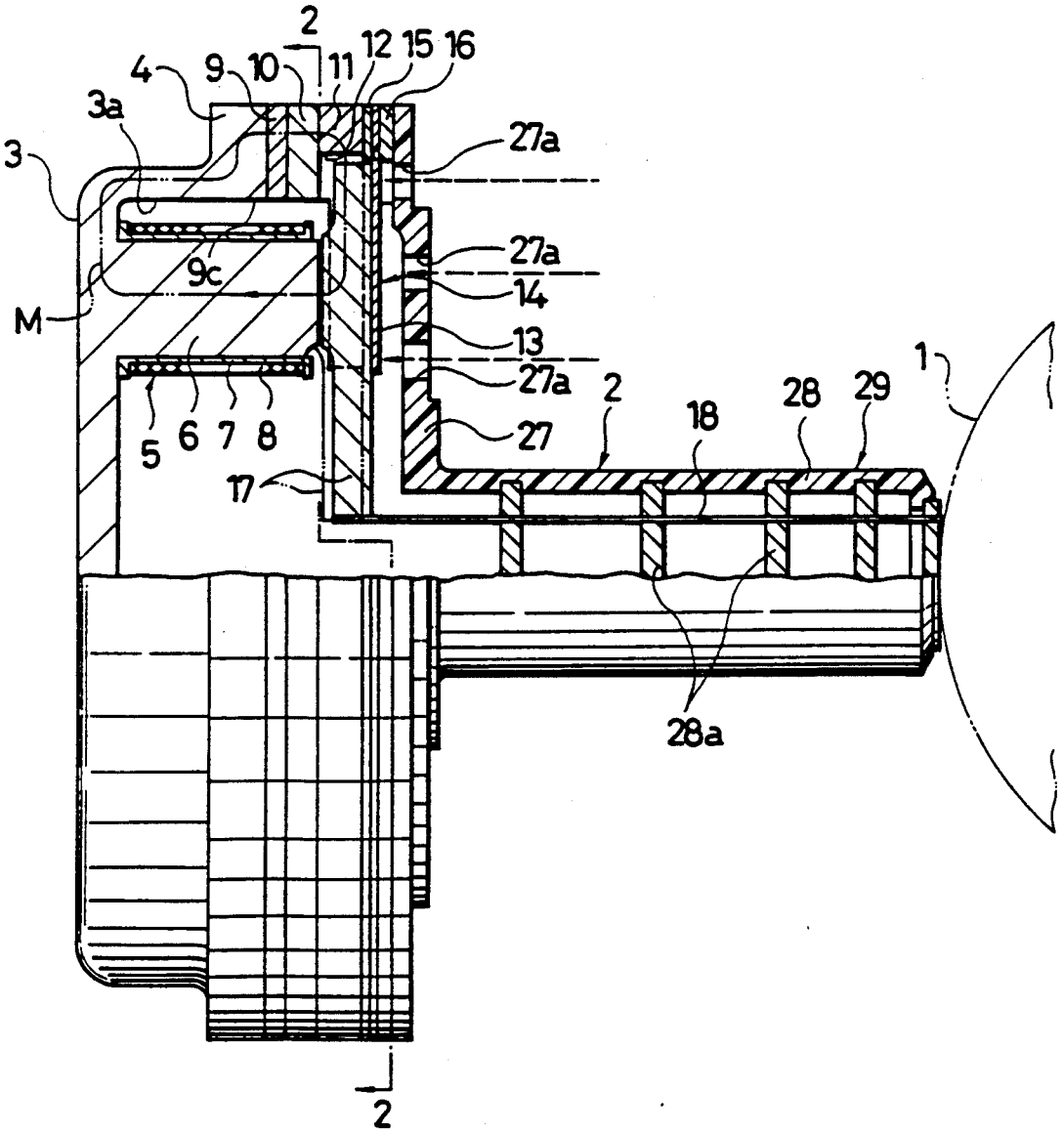
FIG. 1 is a cutaway side view of a print head assembly according to a first embodiment of the present invention.
Figure 2:
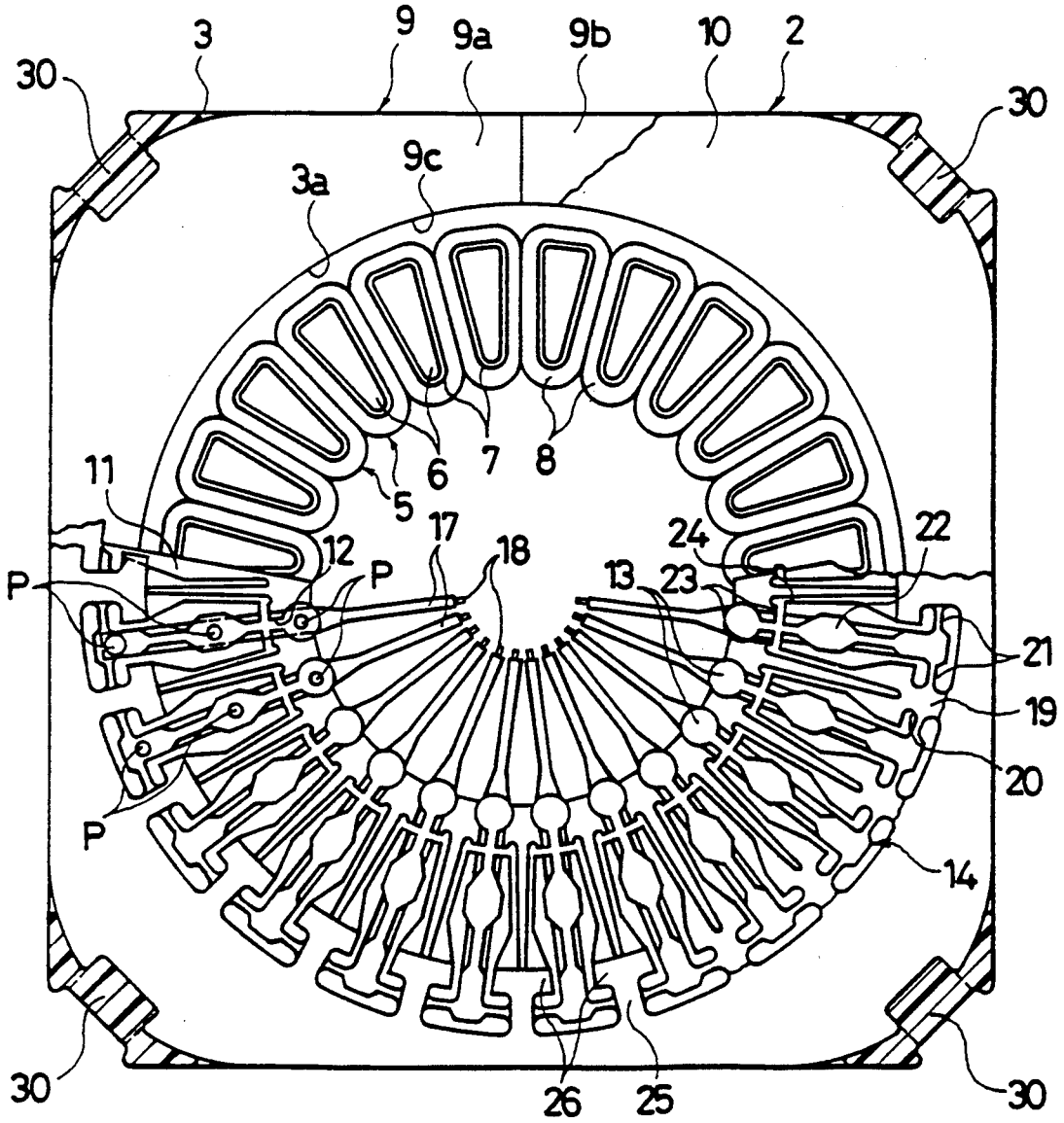
FIG. 2 is a sectional view taken along line 2—2 of FIG. 1.
Figure 3:
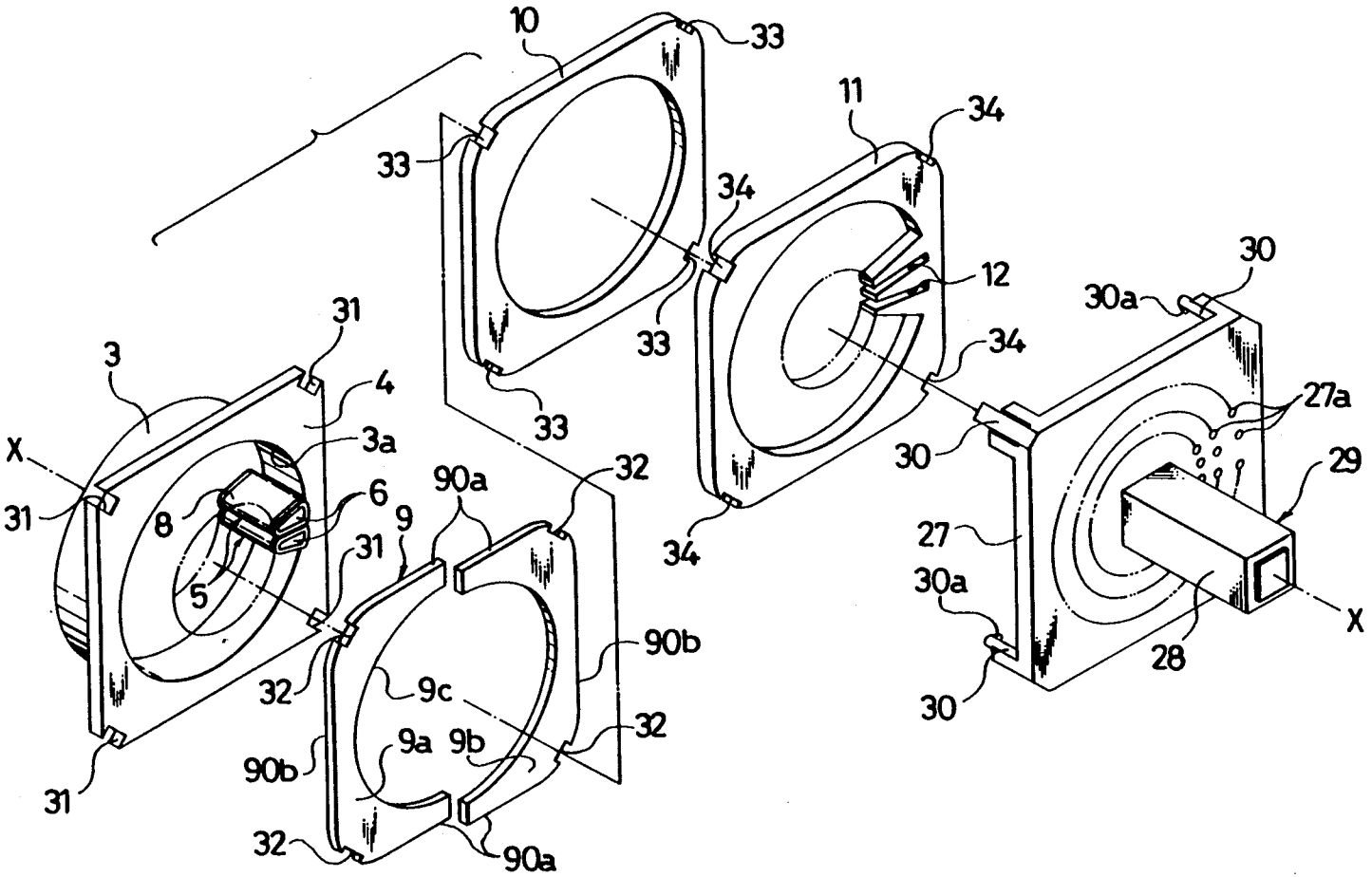
FIG. 3 is an exploded perspective view showing the way principal components of the print head assembly of FIG. 1 are assembled.

As shown in FIG. 1, a print head 2 is disposed in front of a platen 1, which extends in the transverse direction of a frame of a printer, or at right angles to the drawing plane, inside the printer frame. The print head 2 can move along a print line on the platen 1. In the description to follow, that side of the print head 2 which faces the platen 1 will be referred to as the front side, and the opposite side as the rear side. In FIG. 1, a printing sheet wound around the platen 1 and a printing ribbon are omitted for simplicity of illustration. As shown in FIGS. 1 to 3, a head body 3 of the print head 2, which is made of magnetic material, is in the form of a bottomed cylinder having a circular recess 3*a* which opens to the platen side. A flange 4 is formed on the outer periphery of the head body 3 on the open-end side thereof. The flange 4 has a rectangular configuration, including upper and lower sides, extending parallel to the print line, and two lateral sides extending at right angles thereto. The outer peripheral wall of the head body 3, including the flange 4, constitutes a rear yoke.

A plurality of electromagnetic devices 5 (24 in number in this embodiment) are arranged in a ring, on the bottom surface of the recess 3*a*. Each electromagnetic device 5 is composed of a core 6 protruding integrally from the head body 3, a coil bobbin 7 fitted on the core 6, and a coil 8 wound around the bobbin 7. The respective cores 6 of the devices 5 are arranged in a ring, at regular intervals, on the head body 3.

A plate-like permanent magnet member 9 is put unmagnetized and fixed on the front face of the flange 4 by adhesive bonding or the like. The magnet member 9 is formed of a pair of half pieces 9*a* and 9*b* arranged symmetrically. The paired pieces 9*a* and 9*b* are butted and fixedly bonded to each other at their facing end portions, and are incorporated in the print head 2. The member 9 has substantially the same external shape as the flange 4, and is formed with a center opening 9*c* which is concentric with the circular ring along which the cores 6 are arranged. A spacer 10, made of magnetic material, is fixed on the front face of the permanent magnet member 9 by adhesive bonding or the like, and a front yoke 11 is bonded to the front face of the spacer 10 by magnetizing the member 9 in the manner mentioned later. The front yoke 11 is formed with a plurality of slits 12 which extend radially, facing their corresponding electromagnetic devices 5.

A plate-like resilient or supporting member 14 is put on the front face of the front yoke 11 in a manner such that it is sandwiched between a pair of spacers 15 and 16 made of magnetic material. The resilient member 14, which is formed of resilient material, has a plurality of radially extending supporting pieces 13 facing the slits 12 individually. A plurality of armatures 17, made of magnetic material, are swingably supported, at their proximal end portions, by their corresponding supporting pieces 13. The respective proximal end portions of the armatures 17 are located inside their corresponding slits 12. Print wires 18, which extend convergently from the central portion of the head body 3 toward the platen 1, are attached, at their proximal ends, to the distal end portions of their corresponding armatures 17. Thus, the resilient member 14, having the supporting pieces 13, constitutes a supporting member for the armatures 17.

Figure 4:
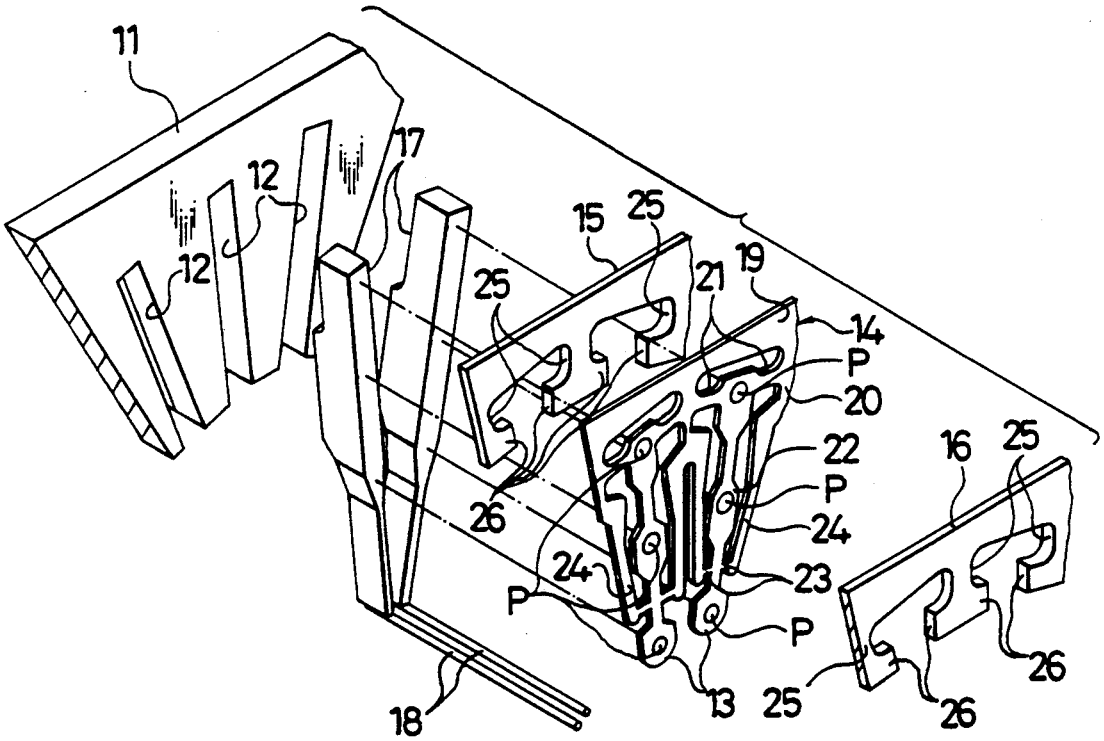
FIG. 4 is an exploded perspective view showing some components of the print head assembly including armatures and a resilient member.

As shown in FIG. 4, an outer peripheral portion 19 of the resilient member 14 is formed integrally with a plurality of coupling portions 20 which are arranged radially between the individual armatures 17. A pair of first torsion bar portions 21 connect each two adjacent coupling portions 20. An armature fixing portion 22 extends radially inward from the junction between the paired first torsion bar portions 21. On the opposite side of the fixing portion 22 to the first torsion bar portions 21, a pair of second torsion bar portions 23 protrude integrally sideways from the fixing portion 22. On each side of each armature fixing portion 22, moreover, the coupling portion 20 and its corresponding second torsion bar portion 23 are connected integrally by means of a leaf spring portion 24.

The first and second torsion bar portions 21 and 23, the armature fixing portion 22, and the leaf spring portions 24 constitute a supporting piece 13 for each armature 17. The armatures 17 are fixed to their corresponding supporting pieces 13 by applying electron beams as welding energy to positions indicated by circles P in FIGS. 2 and 4, through apertures 27*a* in a plate-like cover member 27 integrally formed with a guide member 29 (mentioned later), with the armatures 17 on the armature fixing portions 22.

Spacers 15 and 16 are each formed integrally with projections 25 which extend so as to overlap the coupling portions 20 of the resilient member 14. A pair of holding portions 26 are formed on each projection 25. The holding portions 26 serve to hold the proximal end portions of each two adjacent leaf spring portions 24, at positions inside the first torsion bar portions 21. The guide member 29 has a nose 28 and a plurality of guide plates 28*a*. The cover member 27 is put on the front face of the spacer 16 so that the cover member 27 is in contact with the spacer 16 and is substantially parallel to the array of the armatures 17. The print wires 18 are movably inserted in the nose 28 and guided by the guide plates 28*a*.

As shown in FIG. 3, four retaining projections 30 protrude integrally rearward from the four corners of the cover member 27 along an axis X—X extending in the member assembling direction, as indicated by a dashed line. A retaining piece 30*a* is formed integrally on the rear end of each retaining projection 30. The retaining pieces 30*a* are adapted to releasably engage the rear face of the flange 4 of the head body 3.

Recesses 31, 32, 33 and 34 of substantially the same shape are formed at the four corners of the flange 4, the permanent magnet member 9, the spacer 10, and the front yoke 11, respectively. Similar recesses are also formed at the four corners of each of the spacers 15 and 16 and the resilient member. These recesses are adapted to engage their corresponding retaining projections 30. As the recesses of the members 4, 9, 10, 11, 15 and 16 engage the retaining projections 30, these members are successively put on and fixed together to the cover member 27.

In assembling the print head 2 with the aforementioned construction, the components including the armatures 17 and the print wires 18 are attached to the guide member 29 in the following manner.

The printing wires 18 are previously fixed to their corresponding armatures 17 by brazing or laser welding. The resilient member 14, along with the spacers 15 and 16 and the front yoke 11, is put on the cover member 27. At this time, the retaining projections 30 engage the recesses at the corner portions of the individual members, thereby positioning the members. Then, while inserting all the print wires 18 into the nose 28 of the guide member 29 to be guided by the guide plates 28*a*, the armatures 17 are arranged corresponding to the individual supporting pieces 13 of the resilient member 14, and are positioned by means of a suitable jig.

In this state, electron beams or laser beams, as shown by the dotted arrows in FIG. 1, are applied to the supporting pieces 13 of the resilient member 14 from the outside of the cover member 27, through the apertures 27*a* (FIGS. 1 and 3) which are formed in the cover member 27, corresponding to the armatures 17. Thus, by the energy of the beams, the armatures 17 can be welded to their corresponding supporting pieces 13, at the points P (FIGS. 2 and 4) on the opposite faces of the pieces 13 to the guide member 29. At this point in time, the attachment of the armatures 17 and the print wires 18 to the guide member 29 is finished, and one assembled unit is completed.

Subsequently, the guide member unit assembled in the aforesaid manner is joined with the head body 3 so as to be in contact with the front face of the spacer 10. In this state, the retaining projections 30 engage their corresponding recesses of the individual members, thereby positioning the members. Then, the permanent magnet member 9 is magnetized to strongly hold the front yoke 11 and the guide member unit by means of its magnetic force. At the same time, the retaining pieces 30*a* are caused to engage the flange 4 of the head body 3, thereby accomplishing the assembling of the whole structure.

The end faces of the cores 6 and the front face of the spacer 10 are ground so as to be flush with one another, thereby ensuring an accurate positional relation with the armatures 17.

Thus, the armatures 17 and the print wires 18 are previously coupled to one another before they are attached to the nose 28 of the guide member 29. In contrast with the conventional case, therefore, there is no need of a fixing operation in a narrow space inside the head body 3. Consequently, the assembling work is facilitated, and the manufacturing cost can be lowered.

In this embodiment, the cover member 27 is formed with the apertures 27*a* through which electron beams pass. Therefore, the armatures 17 can be fixed to the resilient member 14 on the side of the guide member 29. Thus, the resilient member 14, which is formed of a leaf spring having a high magnetic resistance, is located outside a magnetic path formed by the permanent magnet member 9, so that the magnetic force of the magnet member 9 can be utilized effectively. Furthermore, the direction of irradiation can be controlled with ease, and the armatures 17 are fixed to the resilient member 14 with use of electron beams with high energy density. Accordingly, such small parts as the armatures can be welded securely with small weld spots, and the torsion bar portions 21 and 23 can hardly be influenced by welding heat. Since each supporting piece 13 is formed integrally of one leaf spring, moreover, the resulting assembly is simple in construction, and the assembling work is easier, thus permitting lower manufacturing cost.

In the printing head assembly constructed in this manner, when the coils 8 of the electromagnetic devices 5 are not energized, the permanent magnet member 9 forms a magnetic path which extends through the spacer 10, front yoke 11, armatures 17, cores 6, and flange 4, as indicated by a two-dot chain line M in FIG. 1. As a result, each armature 17 is attracted to the whole end face of its corresponding core 6, and each print wire 18 is situated in its rear or rest position, as indicated by a chain line in FIG. 1. Also, each supporting piece 13 of the resilient member 14 is moved rearward, so that the torsion bar portions 21 and 23 are deformed torsionally, and the leaf spring portions 24 are bent, thereby accumulating an urging force.

In this state, when the coils 8 of the electromagnetic devices 5 are energized selectively so that the cores 6 are temporarily excited to cancel the magnetic path, the armature 17 corresponding to the energized coil 8 is swung around the first torsion bar portions 21 to a printing position, as indicated by a full line in FIG. 1, by the urging force of the portions 21, 23 and 24. Thereafter, the armature 17 is swung back to and held again in its rest position, attracted by the magnetic force of the permanent magnet member 9. As the printing wire 18 reciprocates, accompanying its corresponding armature 17, the printing sheet (not shown) on the platen 1 is subjected to a dot-printing operation with the aid of the printing ribbon (not shown) between the print head 2 and the platen 1.

In this embodiment, the outer peripheral portion of the permanent magnet member 9 has a rectangular outline. As shown in FIG. 3, the outer peripheral portion includes upper and lower first outer peripheral edges 90*a* and a pair of lateral or second outer peripheral edges 90*b*. When the print head 2 is set in the printing device, the first edges 90*a* are situated parallel to the print line, while the second edges 90*b* extend at right angles to the print line. Thus, the distance between the first edges 90*a* corresponds to the height of the print head 2, while the distance between the second edges 90*b* corresponds to the width of the head 2. The members 4, 10, 11 and 27 and other members of the print head 2, which are combined together with the magnet member 9, have an outer peripheral portion whose shape is substantially the same as that of the magnet member 9.

Thus, the height and width of the magnet member 9 are equivalent to those of the print head 2. Even if the height and width are shorter than the diameter of the conventional circular head, the magnet member 9 can enjoy a wide enough area, as a whole, owing to the substantial extension of its corner portions. Despite the compact design, involving a reduction in height and width of the print head 2, therefore, a wide effective area can be maintained which permits production of the magnetic force of the permanent magnet member 9.

In the embodiment described above, the permanent magnet member 9 is rectangular in shape. Alternatively, however, it may have the shape of an octagon or any other polygon.

Figure 5:
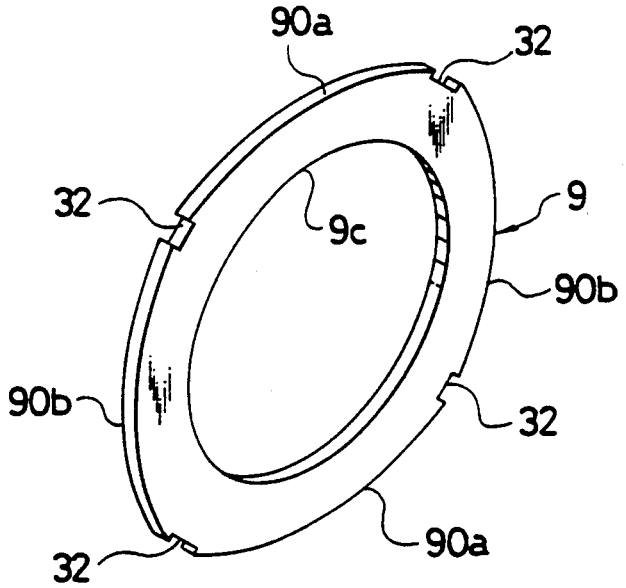
FIG. 5 is a perspective view showing a modification of a permanent magnet member.

FIG. 5 is a perspective view showing a modification of the permanent magnet member. In FIG. 5, like reference numerals refer to like portions as included in the first embodiment. In this modification, the first and second outer peripheral edges 90*a* and 90*b* of the outer peripheral portion, which are defined by straight lines in the first embodiment, are somewhat outwardly convex in shape.

According to the present invention, as described in connection with the first embodiment, the print head 2 is assembled in a manner such that the components 9, 10 and 11 and other components are interposed between the cover member 27 and the head body 3, and that the retaining projections 30 of the cover member 27, which constitute retaining projection means, engage their corresponding engaging recesses 31 of the head body 3, which constitute engaging means. The middle portion of each retaining projection 30 is fitted tight in grooves 32, 10*a* and 11*a*, as positioning groove means, at the corner portions of the respective outer peripheral portions of the members 9, 10 and 11, between the head body 3 and the cover member 27. Thus, the relative positions of all these members, with respect to the direction around the axis X—X extending in the assembling direction, are fixed.

At the time of assembling, the retaining projections 30 are deformed elastically, and the retaining pieces 30*a* are snapped in their corresponding engaging recesses 31 of the head body 3. The engagement is maintained by the resilience of the projections 30. According to this arrangement, in contrast with the prior art arrangement, the head body 3 need not be formed with any positioning pins which penetrate the members. Thus, the manufacture of the print head assembly is facilitated, and the individual members can be bonded together with higher accuracy. Accordingly, the variation of the stroke of each armature is reduced, and the print wires 18 can produce prints of improved uniformity.

In contrast with the arrangement of the aforementioned embodiment, moreover, the retaining projections 30 and the engaging recesses 31 may be provided on the sides of the head body 3 and the cover member 27, respectively.

Referring now to FIGS. 6 to 10, a print head assembly according to a second embodiment of the present invention will be described. The first and second embodiments share most components in common. Therefore, like reference numerals are used to designate like portions or components throughout the drawings for simplicity of illustration.

In the second embodiment, a resilient retaining member 36 is put on the cover member 27, on its front side or on the opposite side thereof to the head body 3.

A ring-shaped central portion 37 of the resilient retaining member 36, which is formed of a spring material, is attached to the front face of the cover member 27. Extending portions 38 protrude radially from the outer periphery of the retaining member 36, arranged at regular intervals. Retaining arms 39, constituting retaining arm means, extend individually from the extending portions 38, substantially at right angles thereto.

A pair of bent resilient pieces 40 are formed integrally on two opposite sides of each extending portion 38. The resilient pieces 40 engage the front face of the cover member 27. A pair of bent retaining pieces 41 are formed integrally on the extreme end portion of each retaining arm 39. The retaining pieces 41 can be fitted individually in each pair of retaining recesses 42, which are formed in the rear face of the flange 4.

The four retaining arms 39, which extend rearwardly along the assembling axis X—X, are situated corresponding to the four retaining projections 30 on the cover member 27. When the retaining member 36 and the cover member 27 are joined together, each retaining arm 39 engages a retaining groove 30*b* (FIGS. 7 and 8) on the outer peripheral surface of its corresponding retaining projection 30. Thus, the relative positions of the retaining member 36 and the cover member 27, with respect to the direction around the axis X—X, are fixed.

The retaining recesses 42 in the flange 4 are formed corresponding to the individual corner portions of the flange 4 at which the engaging recesses 31 are formed.

Figure 9:
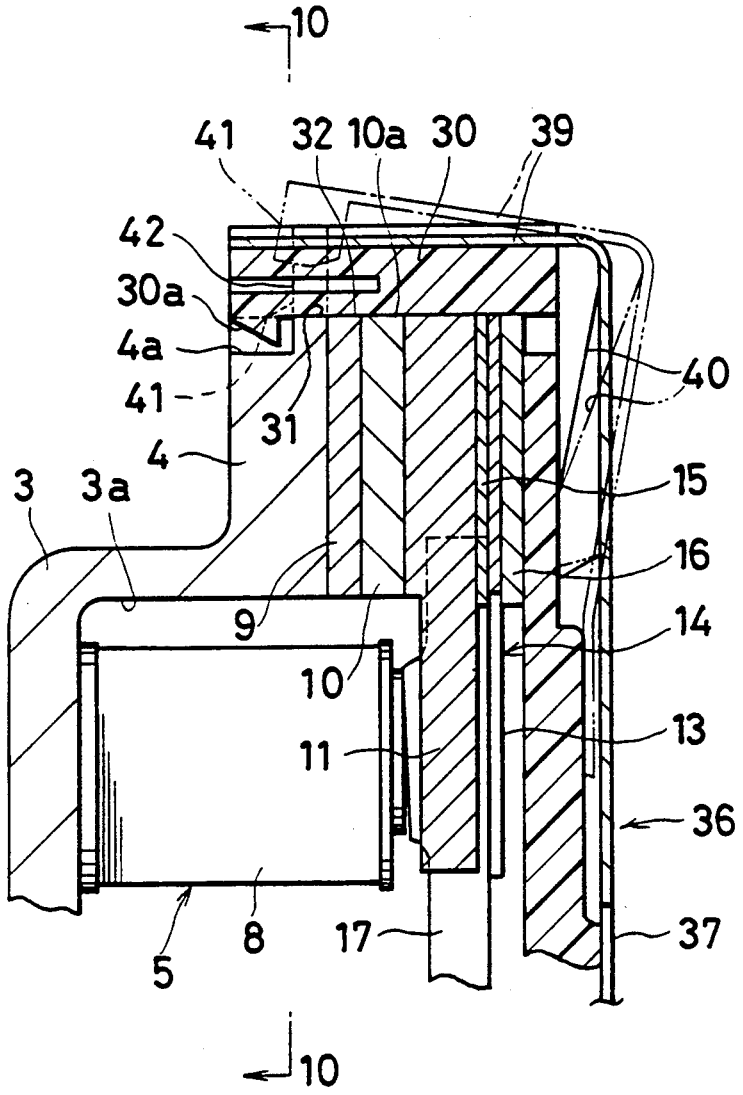
FIG. 9 is an enlarged sectional view of the principal part of the print head assembly as taken along line 9—9 of FIG. 7, illustrating the way a resilient retaining member is mounted.
Figure 10:
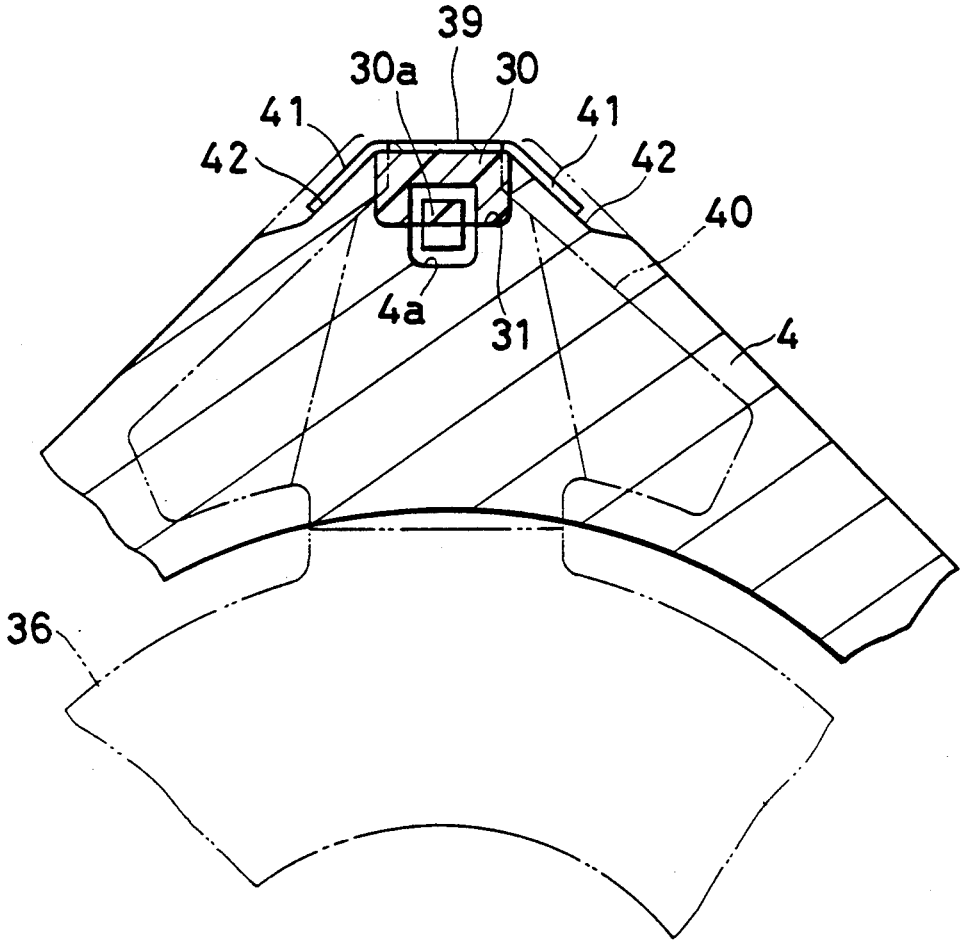
FIG. 10 is a sectional view of the principal part as taken line 10—10 of FIG. 9.

In a natural state, as indicated by a two-dot chain line in FIG. 9, the retaining member 36 is situated so that the retaining pieces 41 of the retaining arms 39 are off the retaining recesses 42. As the retaining arms 39, in this state, are pushed toward the four corners of the head body 2 against their own resilience, the retaining pieces 41 engage their corresponding retaining recesses 42, and the resilient pieces 40 are brought resiliently into contact with the cover member 27. By such a resilient action, the retaining pieces 41 are locked or fixed in the retaining recesses 42. Thus, the assembling state of the print head can be maintained more securely.

In the second embodiment, as in the first embodiment, the retaining projections 30 engage their corresponding engaging grooves 31. The print head has the retaining pieces 30*a* of the retaining projections 30 individually in notches 4*a*, which are formed individually on the engaging grooves 31.

Thus, in the second embodiment, the retaining projections 30, having the retaining pieces 30*a*, are used for preassembling, while the resilient retaining member 36 is used for final assembling.

After the retaining pieces 30*a* of the retaining projections 30 are caused, for preassembling, to engage their corresponding notches 4*a*, relatively loosely or just tight enough to prevent disengagement, the permanent magnet member 9 is magnetized. Thereupon, the components 4, 10, 11, 14, 15 and 16 are coupled together by means of the magnetic force of the magnet member 9. Thereafter, the resilient retaining member 36 is used to accomplish the final assembling with high accuracy. Thus, the assembling work can be performed in two steps. Owing to the process of preassembling, the print head assembly cannot be disassembled when it is transferred between processes, before the permanent magnet member 9 is magnetized. Consequently, the assembling work is safe and secure.

Since the retaining arms 39 of the resilient retaining member 36 are situated along the outer peripheral surfaces of their corresponding retaining projections 30, as mentioned before, their middle portions, like those of the retaining projections 30, engage the retaining grooves 32, 33 and 34 of the permanent magnet member 9, the spacer 10, and the front yoke 11, respectively. By this engagement, the relative positions of the individual members can be settled more accurately.

Figure 6:
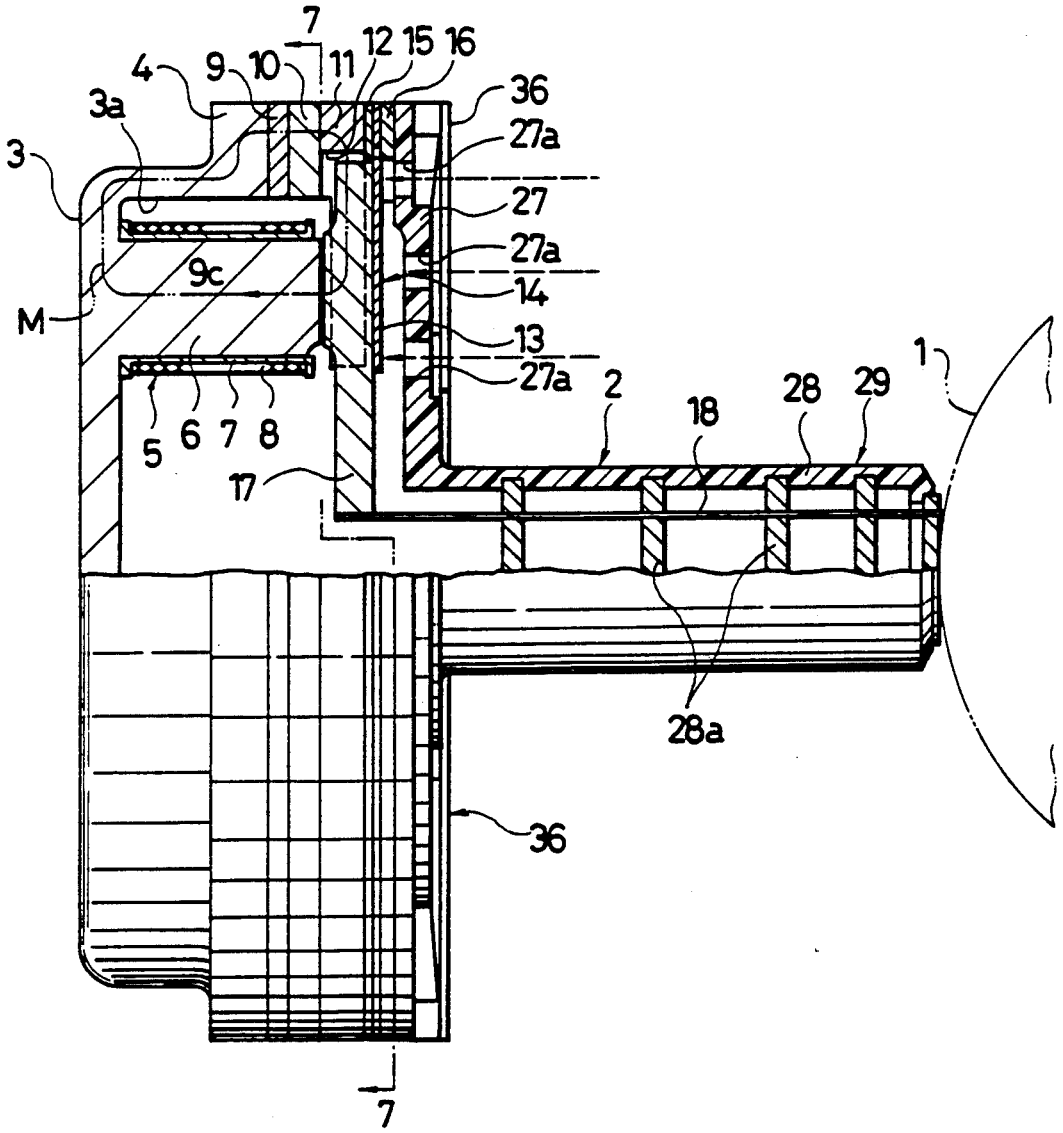
FIG. 6 is a cutaway side view of a print head assembly according to a second embodiment of the present invention.
Figure 7:
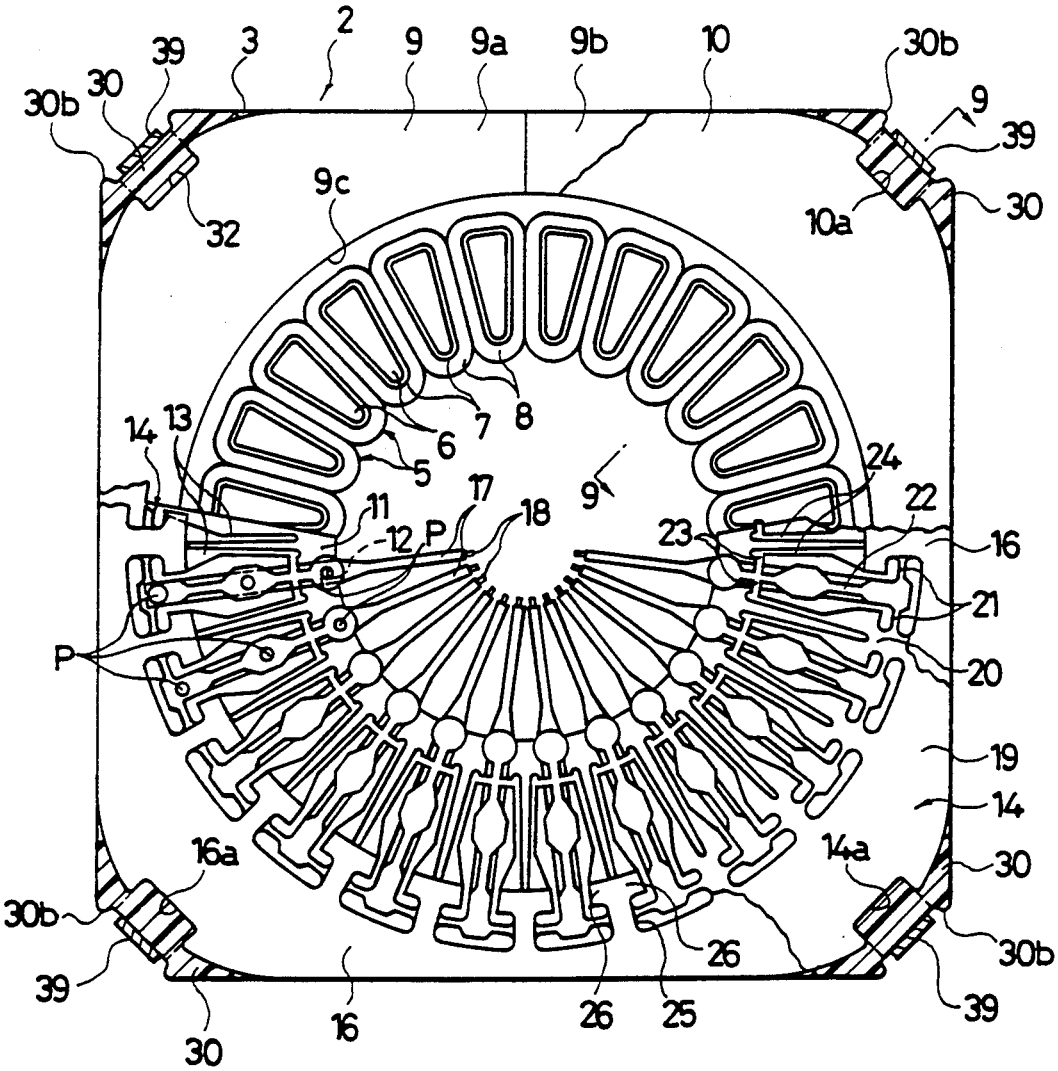
FIG. 7 is a sectional view taken along line 7—7 of FIG. 6.

As in the case of the first embodiment, the armatures 17 are fixed to their corresponding supporting pieces 13 of the resilient member 14 by externally applying laser beams or the like, as shown by the dotted arrows in FIG. 6, through the apertures 27*a* in the cover member 27, before, the guide member 29 is attached to the head body 3. Thus, the fixing operation can be performed very easily.

In the embodiments described herein, the retaining projections 30 are formed integrally on the cover member 27. Alternatively, however, they may be attached separately to the cover member 27.

Referring to FIGS. 11 to 19, a print head assembly of a third embodiment of the invention will now be described.

Figure 11:
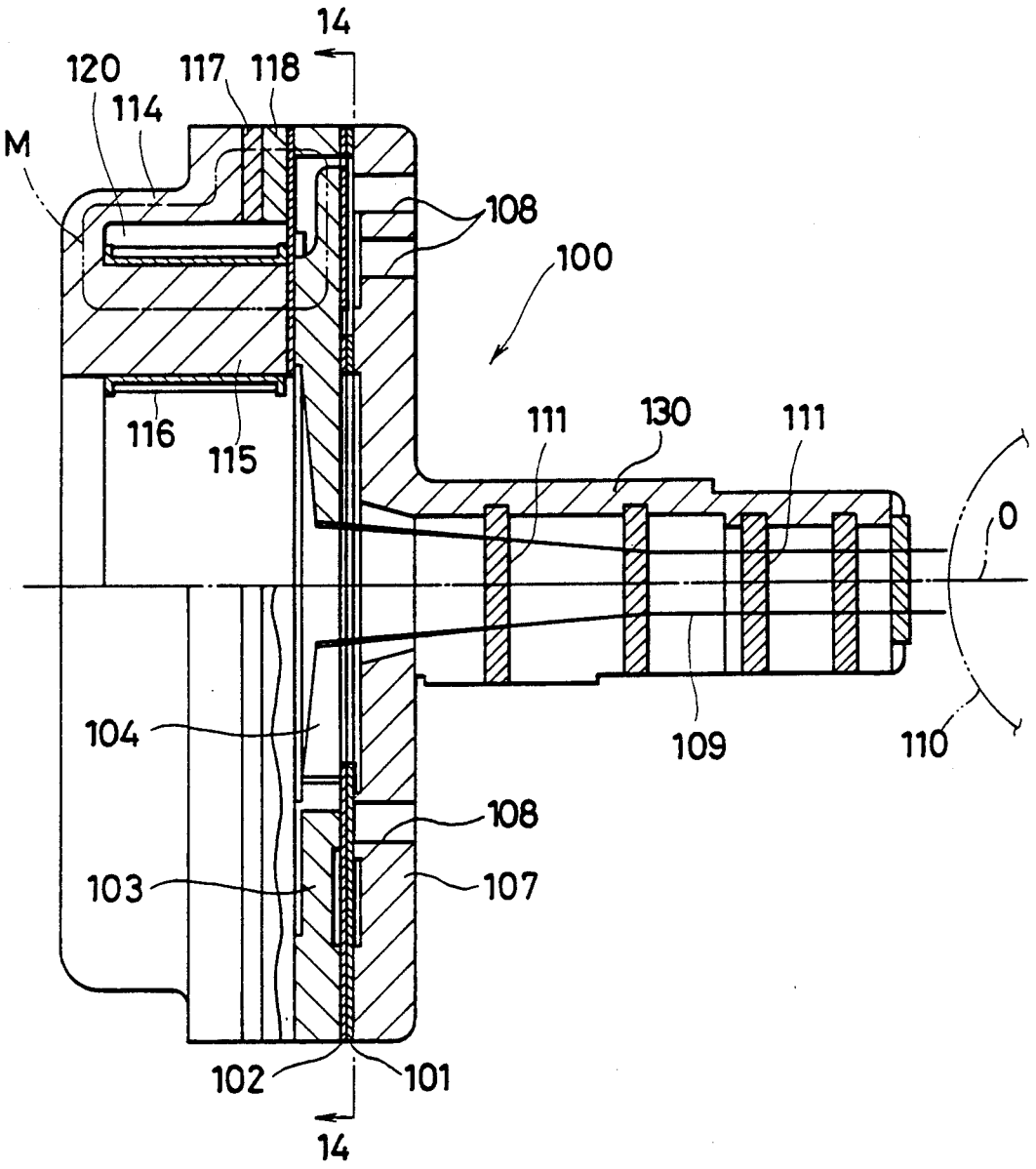
FIG. 11 is a cutaway side view taken along line D-O-E in FIG. 16 showing a print head assembly according to a third embodiment of the invention.
Figure 12:
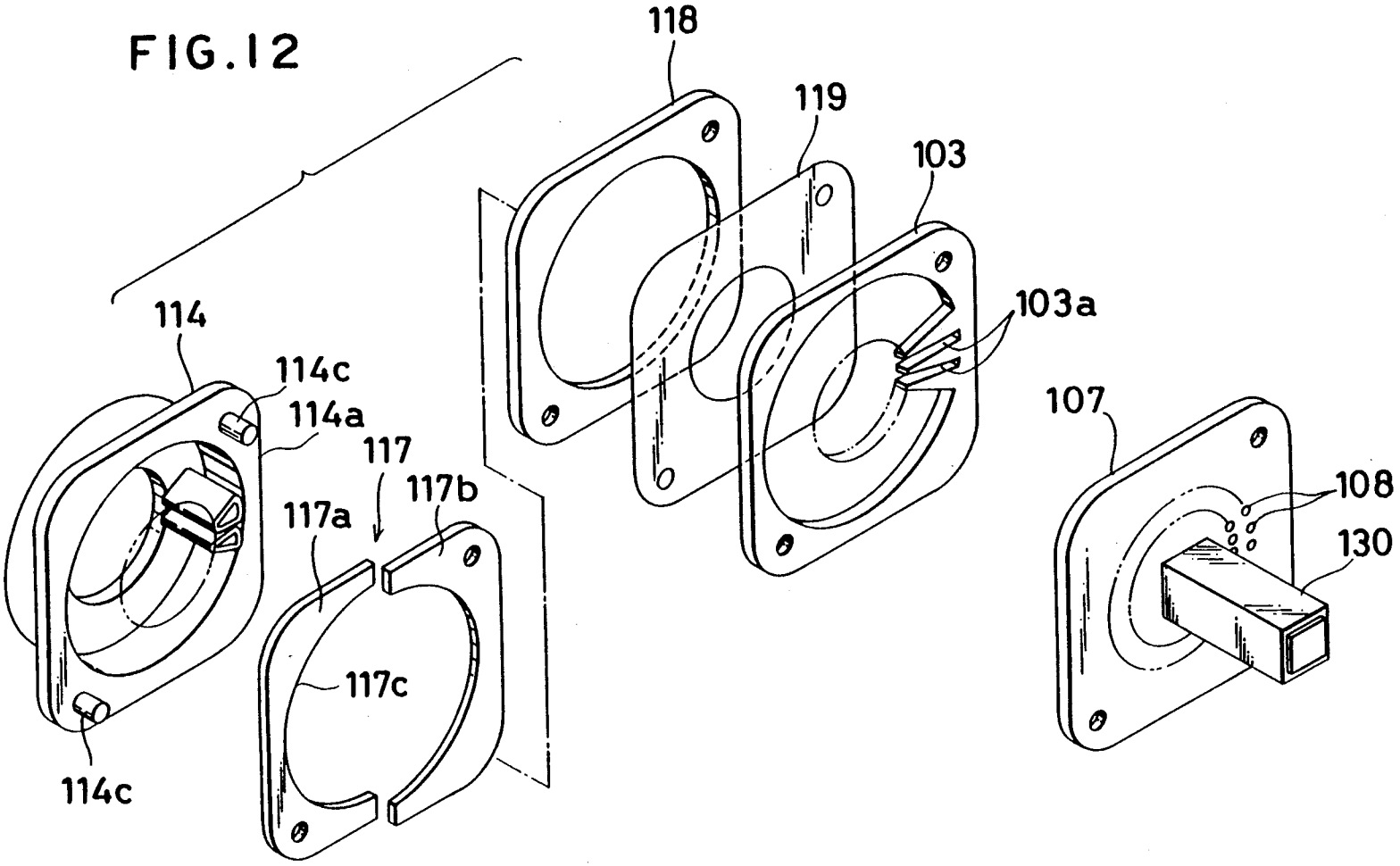
FIG. 12 is an exploded perspective view illustrating the way of assembling of principal components of the print head assembly shown in FIG. 11.
Figure 13:
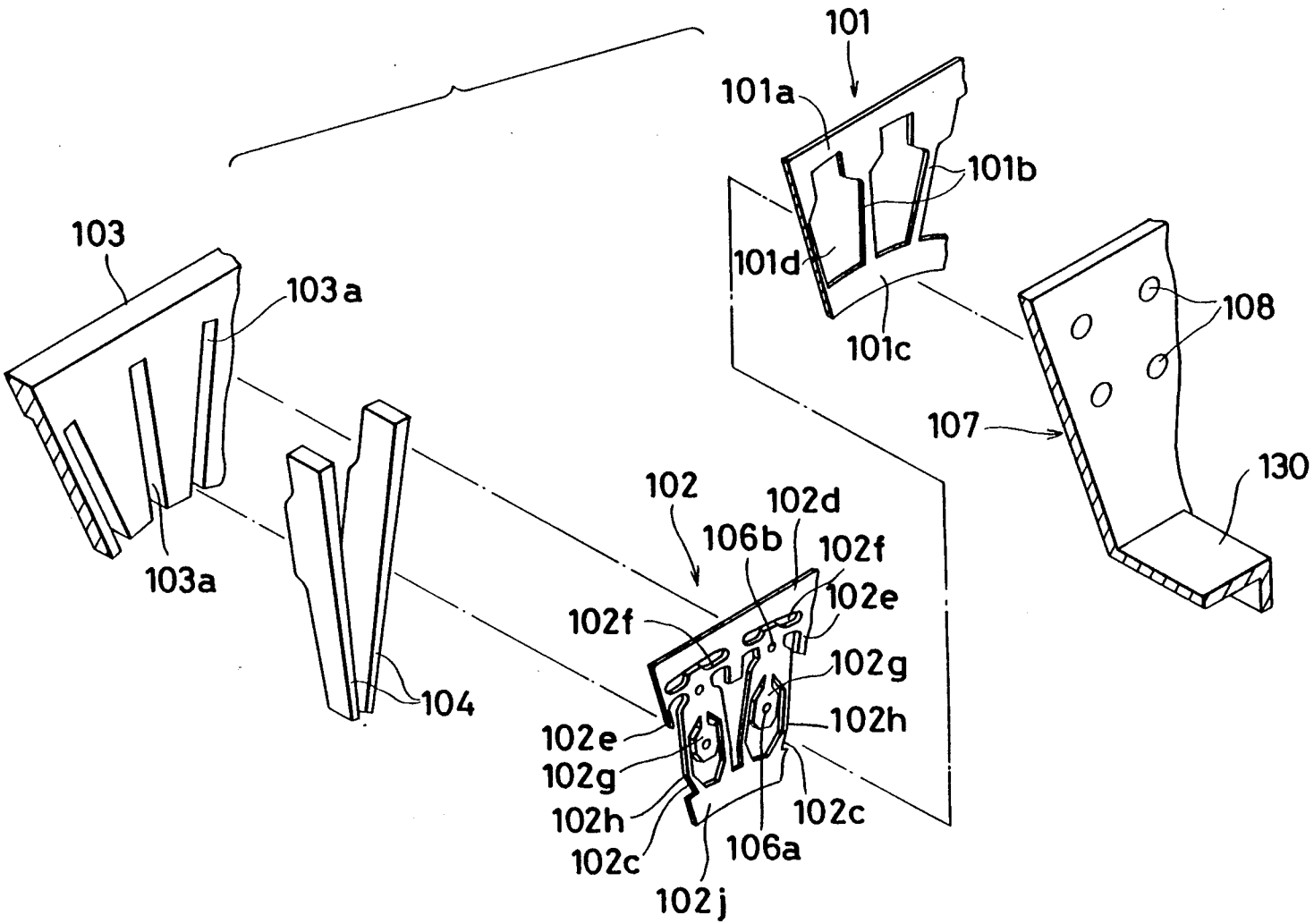
FIG. 13 is an exploded perspective view showing some components of the print head assembly shown in FIG. 11 including a cover member, a spacer and a supporting member.
Figure 14:
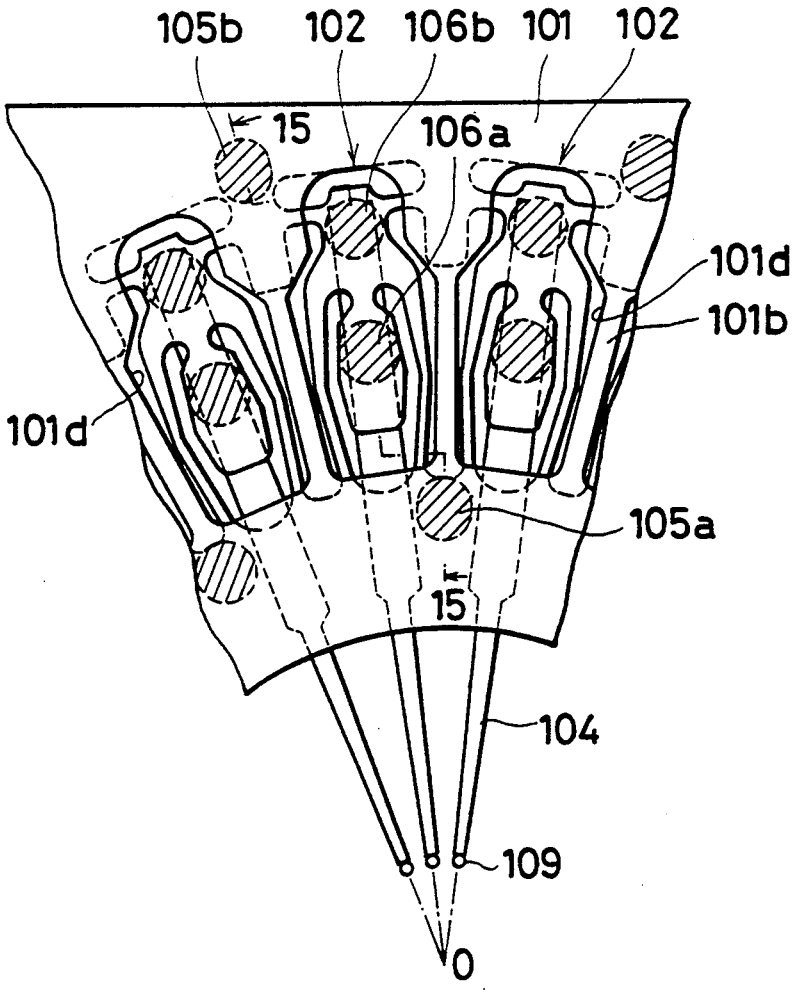
FIG. 14 is a fragmentary enlarged-scale sectional view taken along line 14—14 in FIG. 11.

This embodiment of a print head assembly will first be summarized with reference to FIGS. 11 to 13. A head body 100 consists of component members made of a magnetic material, and its rear yoke 114 has a circular recess 120 defined by its bottom and cylindrical peripheral wall and open toward a platen 110. The rear yoke 114 has a rectangular flange portion 114*a* outwardly extending from its end on the side nearer the platen 110 (hereinafter referred to as front end). The bottom of the recess 120 is formed with a plurality of cores 115 arranged at a regular interval in a ring-like array. Coils 116 are individually wound on the respective cores 115.

A plate-like permanent magnet 117 is secured by bonding to the front end of the rear yoke 114. The permanent magnet 117, as shown in FIG. 12, consists of a pair of, i.e., left and right, halves 117*a* and 117*b* having the opposed ends thereof bonded together, and it has a central opening concentric with the circle of array of the cores 115.

A spacer 118 made of a magnetic material is bonded to the front surface of the permanent magnet 117. A front yoke 103 is provided on the front surface of the spacer 118. The front yoke 103 has a plurality of slits 103*a* extending radially in correspondence to the respective cores 115. A film 119 is interposed for wear prevention between the front yoke 103 and spacer 118 such that it covers the front ends of the cores 115. As shown in FIG. 13, a leaf spring member (maraging steel, 0.38 mm thick) 102 is interposed as a supporting member between the front surface of the front yoke 103 and the spacer 101 made of a magnetic material. A plurality of armatures 104 are supported at a regular interval and for swinging by respective resilient supporting portions 102*c*, to be described later, of the leaf spring 102. The individual armatures 104 have their stem portions disposed in the respective slits 103*a* of the front yoke 103 and have their free ends, to each of which is attached one end of each of print wires 109 which extend as a bundle in a central portion of the head body 100 toward the platen 110 as shown in FIG. 11.

On the front surface of the spacer 101 are mounted a cover member 107 made of aluminum and a guide member 130 integral therewith. The cover member 107 is plate-like in shape and covers the individual armatures 104. The guide member 130 constitutes a forwardly projecting cylindrical nose. The guide member 130 is secured by the cover member 107 to the spacer 101, and print wires 109 are movably inserted through the guide member 130. Reference numeral 111 designates guide plates for guiding the print wires 109.

Figure 15:
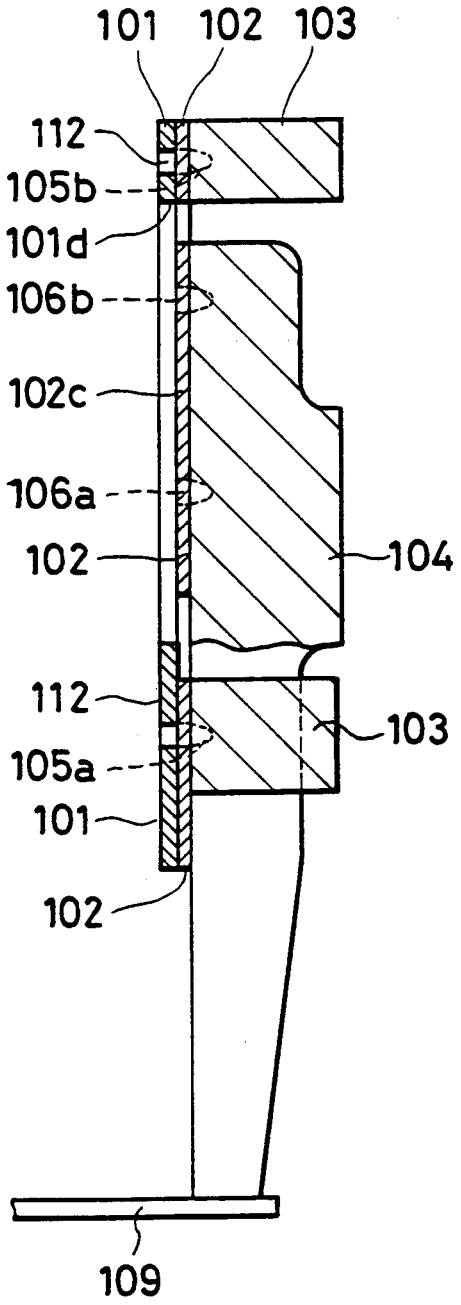
FIG. 15 is an enlarged-scale sectional view taken along line 15—15 in FIG. 14 showing beam-welded members.
Figure 16:
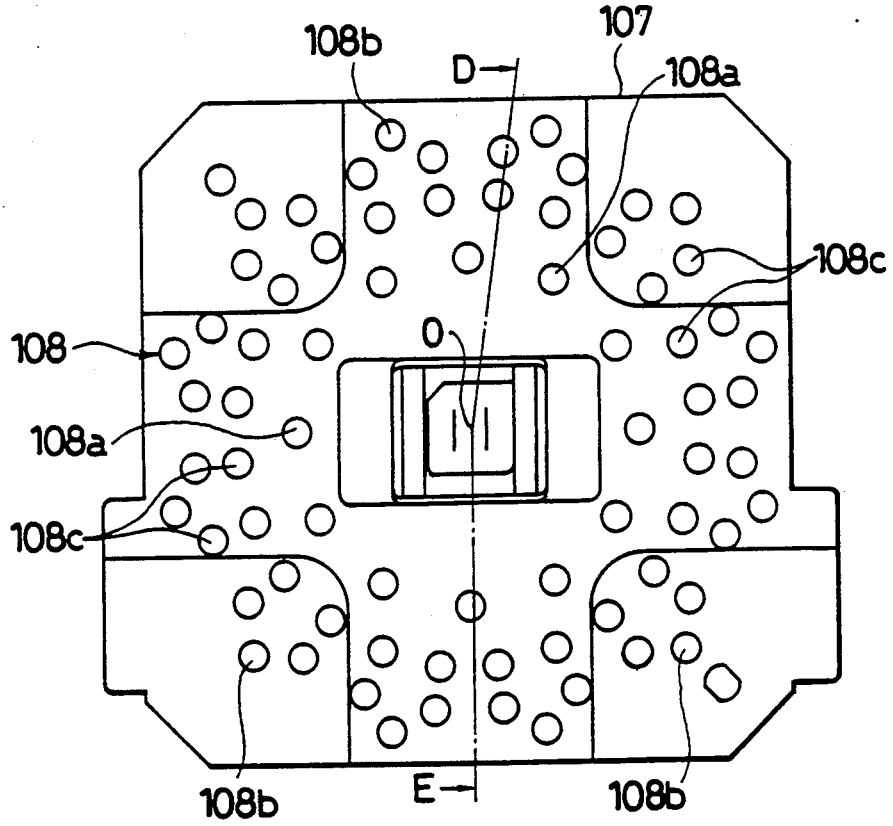
FIG. 16 is a view taken from the plate side of the dot print head assembly shown in FIG. 11.

The structure of mounting the armatures 104 will now be described. As shown in FIGS. 13 and 15, the leaf spring 102 has a substantially ring-shaped edge portion 102*d*, the inner edge of which is formed with a plurality of stem portions 102*e* extending radially toward the center of the print head. Torsion bar portions 102*f* are each formed between and integrally with adjacent stem portions 102*e* such that they are located over the stems of the armatures 104. The individual torsion bar portions 102*f* have radially extending central connecting portions 102*g*. The individual armature members 104 are overlapped over the respective connecting portions 102*g* and welded to these portions 102*g* each at two points 106*a* and 106*b* as shown in FIG. 13.

Each torsion bar portion 102*f* also has a pair of curved portions 102*h* extending on the opposite sides of the connecting portion 102*g*. The curved portions 102*h* are united near the torsion bar portions 102*f* to a connecting portion 102*g*, which is found near the center of the print head and constitutes an inner edge portion. The curved portions 102*h* are united at the other end to the connecting portions 102*g*. The torsion bar portions 102*f*, connecting portions 102*g* and curved portions 102*h* constitute resilient supporting portions 102*c* which support the respective armature members 104.

Figure 17:
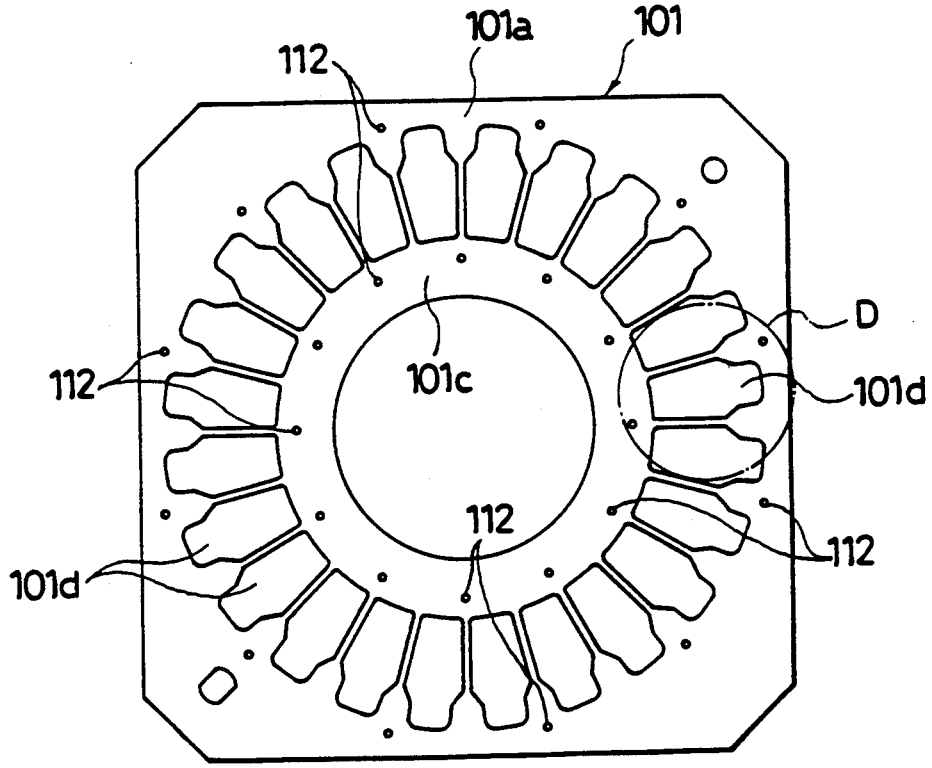
FIG. 17 is a plan view showing a spacer.

The spacer 101 has a ring-like outer edge portion 101*a*, a plurality of connecting arm portions 101*b* radially inwardly extending from the portion 101*a* and a ring-like inner edge portion 101*c* concentric with the connecting portion 102*j* of the leaf spring 102 and integral with the other end of the arm portions 101*b*. As shown in FIG. 13, the end of each connecting arm portion 101*b* on the side of the outer edge portion 101*b* has a greater width than the width of each stem portion 102*e* of the leaf spring 102 to suppress flexing of the stem portion 102*e* with a twisting motion of the torsion bar portion 102*f*. Openings or holes 101*d* are each defined between adjacent ones of the connecting arm portions 101*b*. The ring-like outer and inner edge portions 102*d* and 102*j* of the leaf spring member 102 are interposed between the ring-like outer and inner edge portions 101*a* and 101*c* of the spacer 101 and front yoke 103. The spacer 101 has a plurality of (i.e., 24 in this embodiment) through holes 112, 0.6 mm in diameter formed at positions as shown in FIG. 17. The spacer 101, leaf spring member 102 and front yoke 103 are welded together by welding energy provided by an electron beam projected on each through hole 112 and a peripheral portion therearound. The through holes 112 in the outer edge 101*a* are each formed for every two stem portions 102*e* of the leaf spring portion 102, and through holes 112 in the inner edge portion 101*c* are each formed between associated adjacent curved portions 102*h* and in a staggered fashion with respect to the through holes 112 in the outer edge portion 101*a*.

The flange portion 114*a* of the rear yoke 114, as shown in FIG. 12, has two pin-like positioning projections 114*c* projecting forwardly from two opposed corners. On the other hand, the cover member 107, permanent magnet 117, spacer 118, film 119, front yoke 103, spacer 101 and leaf spring member 102 individually have engagement holes formed at corresponding corners to and for receiving the positioning projections 114*c*. The individual members are overlapped in a predetermined order over the flange portion 114*a* of the rear yoke 114 with the positioning projections 114*c* received in the engagement holes noted above, thus determining the positions of the members relative to one another, and these members are coupled integrally with suitable coupling means (not shown). The cover member 107 has a plurality of (i.e., 72 in the illustrated case) electron beam passage holes 108, 2 mm in diameter.

In FIG. 11, a magnetic path M of the permanent magnet 117 is shown. When the coils 116 are not energized, the armatures 104 are held attracted to the coils 115 against the resilient force of the leaf spring member 115 by the magnetic force of the permanent magnet 117, and twisting resilient forces are stored in the torsion bar portions 102*f* of the leaf spring member 102 and bending resilient forces in the curved portions 102*h*. When each coil 116 is energized, it generates a magnetic flux extending in the opposite direction to the direction of the magnetic flux of the permanent magnet 117 to cancel temporarily the magnetic flux of the permanent magnet 117, whereupon the corresponding armature 104 is separated from the associated core 115 by the resilient force of the leaf spring member 102. As a result, the associated print wire 109 is moved, so that its end is brought into contact with the platen 110.

While the head body 100 has the construction as described above, the welding of the spacer 101, leaf spring member 102 and front yoke 103 to one another and welding of the leaf spring member 102 and armature members 104 to one another are performed as follows. First, the spacer 101, leaf spring member 102 and front yoke 103 are overlapped over the cover member 107, and these members are positioned relative to one another by a positioning device (not shown). Then, the print wires 109, which have been bonded to the respective armature members 104 in advance, are inserted through the guide member 130, and the stem portions of the armature members 104 are fitted in the respective slits 103*a* of the front yoke 103 with a predetermined gap formed with respect to the slits 103*a* and are held in this state with a suitable device. At this time, the holes 108*b* and 108*a* in the respective outermost and innermost circles among the electron beam passage holes 108 in the cover member 107 are aligned with the through holes 112 in the two circles of the spacer 101. Further, the armature members 104 and connecting portions 102*g* of the leaf spring member 102 are located in the central opening or hole 101*d* of the spacer 101, and the other holes 108*c* are aligned with the connecting portions 102*g*.

Figure 8:
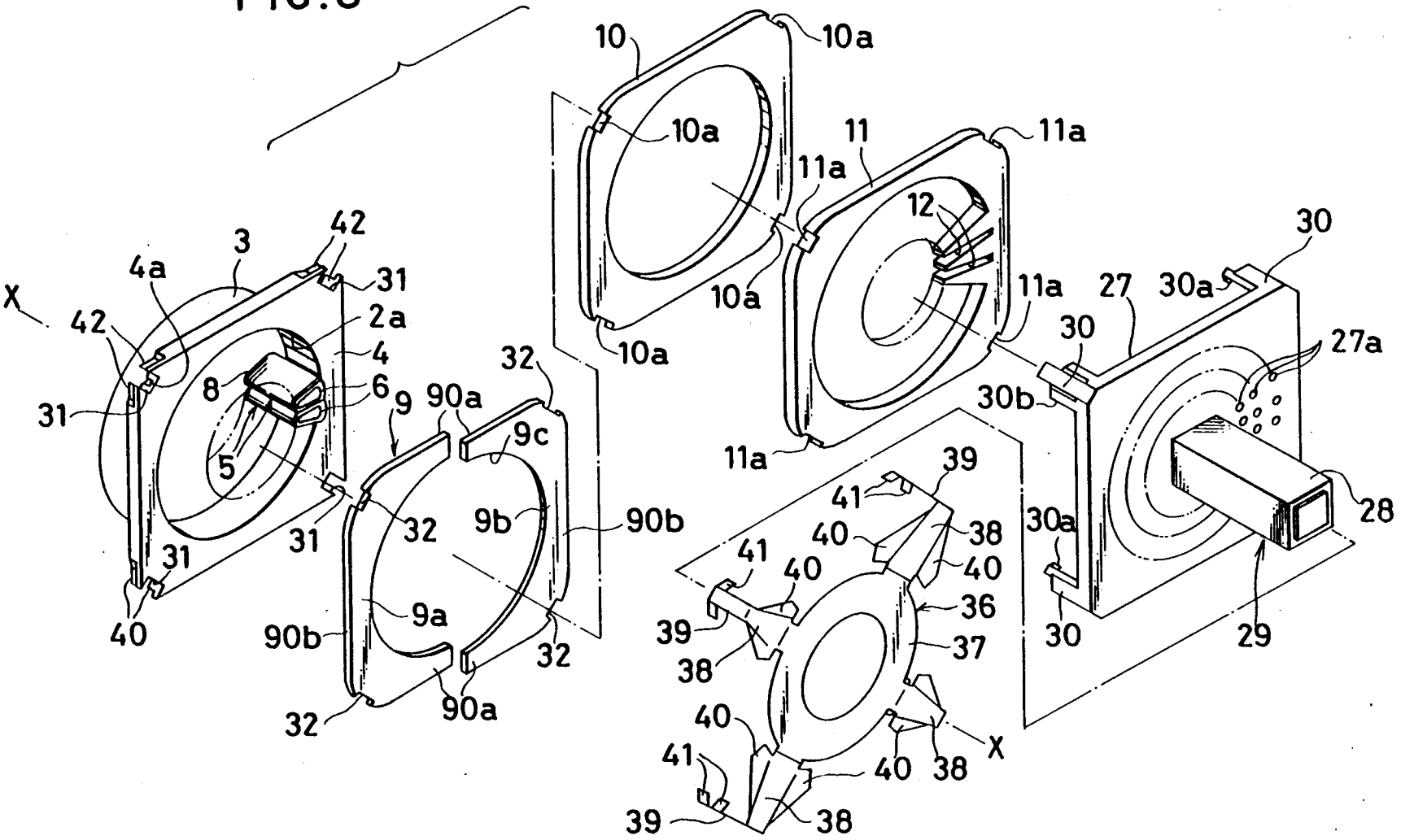
FIG. 8 is an exploded perspective view showing the way principal components of the print head assembly of FIG. 6 are assembled.

In the above state of assembly, the through holes 112 and surrounding portions therearound of the spacer 101 are irradiated with an electron beam passing through the electron beam passage holes 108*a* and 108*b*. For example, an electron beam is scanned diametrically across the through hole 112, as shown in FIG. 8, in a range L wider than the diameter of the through hole 112 but narrower than the diameter of the electron beam passage holes 108*a* and 108*b*. As a result, portions of the leaf spring member 102 and front yoke 103 in the through hole 112 are directly welded together. Also, along the edge of the through hole 112 the spacer 101 and leaf spring member 102 are welded together and also to the front yoke 103.

The electron beam passing through the other electron beam passage holes 108*c* of the cover member 107 irradiates the connecting portions 102*g* of the leaf spring member 102 to effect welding of the connecting portions 102*g* to the armature members 104. In FIG. 15, resultant weldments 106*a* and 106*b* are shown.

Weldments 105*a* and 105*b* are obtained as a result of welding of the spacer 101, leaf spring member 102 and front yoke 103 under the same welding conditions as those, under which the weldments 106*a* and 106*b* are obtained as a result of welding of the connecting portions 102*g* of the leaf spring member 102 to the armature members 104, because the spacer 101 has the through holes 112. In other words, the focus of the electron beam is the same for the weldments 105*a* and 105*b* and for the weldments 106*a* and 106*b*, and substantially the same welding results can be obtained with the weldments 105*a* and 105*b* as with the weldments 106*a* and 106*b*.

Figure 18:
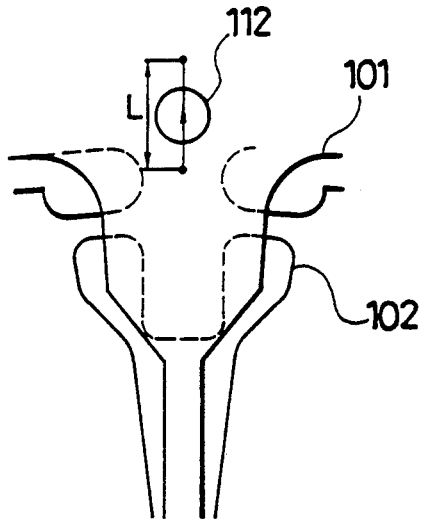
FIG. 18 is a fragmentary enlarged-scale view from FIG. 14 for explaining a welding process.
Figure 19:
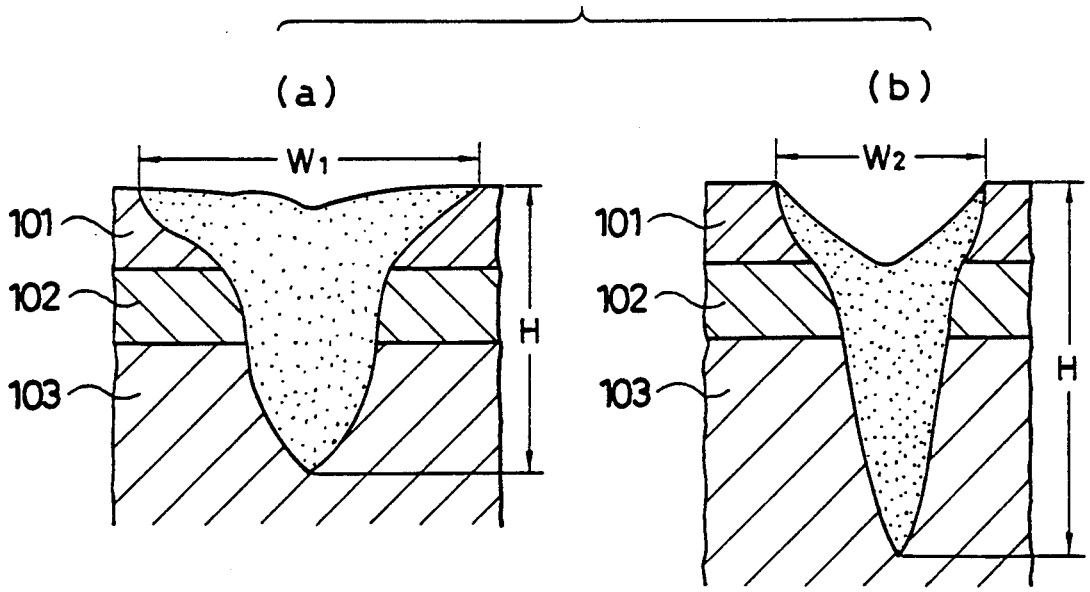
FIGS. 19(*a*) and 19(*b*) are fragmentary enlarged-scale sectional views showing weldments obtained by providing no through hole and by providing a through hole, respectively.

FIGS. 19(*a*) and 19(*b*) show the sectional shapes of a welding bead in the case where the through holes 112 are formed in the spacer 101 and in the case where no through hole is formed, respectively. In the case of FIG. 19(*a*), in which the through holes 112 are not formed, the beam current is set to 5 mA, and the welding speed, at which the beam is scanned in the direction L in FIG. 18, is set to 0 3 m/min. In the case of FIG. 9(*b*) where the through holes 112 are provided, the beam current is set to 5 mA, and the welding speed is set to 0.8 m/min.

It will be seen that in the case of FIG. 19(*b*) where the through holes 112 are provided the depth H of the welding bead, and hence the welding strength, is greater than in the case of FIG. 19(*a*) where no through hole is provided. In the former case of FIG. 19(*a*), it is intended to increase the depth of the welding bead by reducing the welding speed. Nevertheless, the depth H of the bead is insufficient. Rather, the bead width $W_1$ is obviously greater than the bead width $W_2$ in the latter case of FIG. 19(*b*). For this reason in the case where the through holes 112 are not formed, if it is intended to increase a predetermined depth of welding bead, the range of thermal influence is extended to spoil the resiliency of the resilient portions of the leaf spring member 102, resulting in ready breakage of the member 102 as confirmed by experiments.

The unit obtained as a result of welding as described above, is overlapped together with the cover member 107 over the rear yoke 114, to which the spacer 118 and permanent magnet 117 are bonded, and fixed to the rear yoke 114 by suitable fixing means.

Referring to FIGS. 20 to 23(*a*) and 23(*b*), a print head assembly as a fourth embodiment of the invention will now be described. These figures illustrate only a leaf spring member 207 as a supporting member and an armature member 206 in the print head assembly, these members being beam welded together. It is to be understood that component members and portions of the assembly which are not shown are like those in the previous embodiments.

Figure 20:
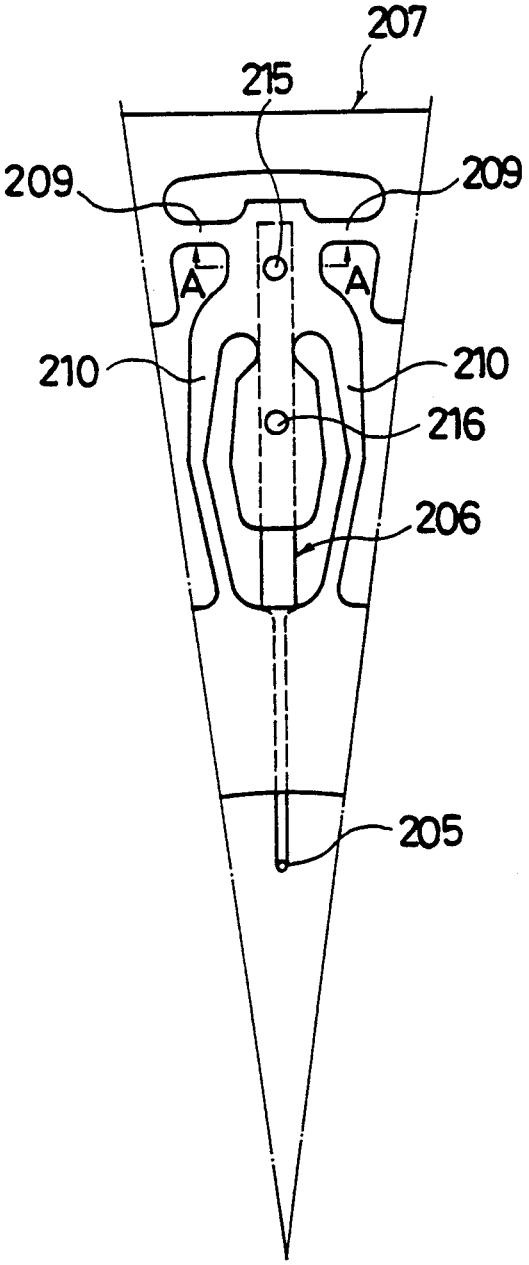
FIG. 20 is a fragmentary view showing a print head assembly according to a fourth embodiment of the invention in a form similar to that of FIG. 14 to illustrate the state of securement of a leaf spring member and an armature member.
Figure 21A:
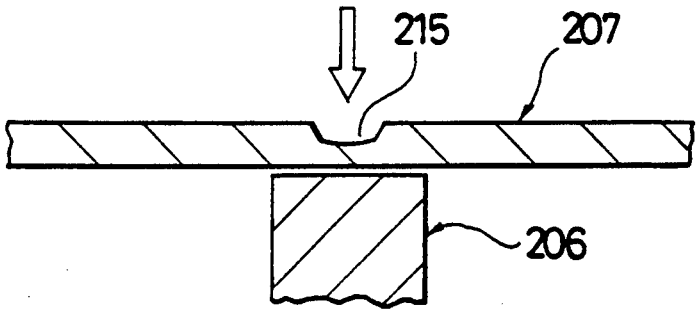
FIG. 21(*a*) is a fragmentary enlarged-scale sectional view taken along line A—A in FIG. 20 for explaining a welding status.
Figure 21B:
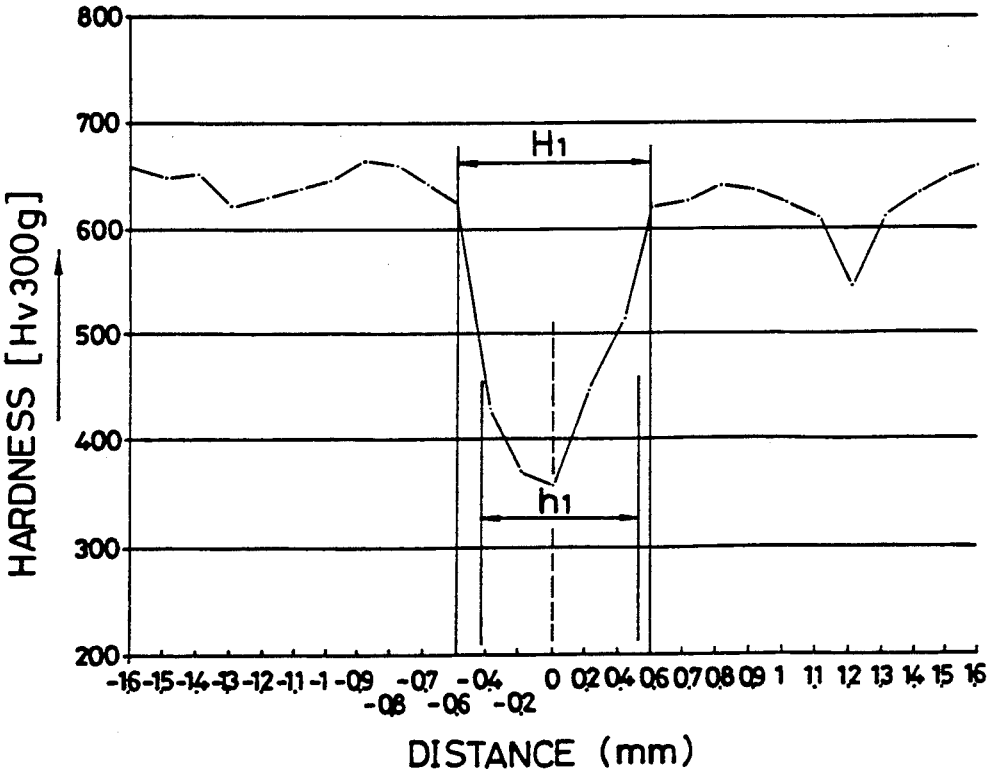

As shown in FIG. 20, the leaf spring member 207, which is a first member to be welded to a second member, has its surface opposite the surface bonded to the armature members 206 and in a bonded portion with circular recesses 215 and 216. The recesses 215 and 216 have a depth corresponding to about one-half of the thickness of the leaf spring member 207. The leaf spring member 207 and armature member 206 as the second member are overlapped as shown in FIG. 21(*a*), and an electron beam or a laser beam is projected as welding energy onto the first and second members from the side, on which the recesses 215 and 216 of the leaf spring member 207 are open, as shown by the arrow. As a method of beam irradiation at this time, each of the recesses 215 and 216 is divided into two semi-circular areas, and each semi-circular area is irradiated independently by an electron beam by moving the electron beam toward the center of the recess from the other side. Although it is possible to effect beam irradiation of each recess with a single electron beam, beam irradiation with two independent electron beams has an effect of reducing the thermal effect on the periphery of the bonded portion. In this embodiment, assuming a maraging steel for the leaf spring member 207 as the first member and silicon steel plate for the armature members 206 as the second member, the beam current and welding speed as electron beam irradiation conditions are set respectively to 6.0 mA and 1.5 m/min.

By forming recesses in the welding area for welding, it is possible to minimize the spread of the thermal influence on the two welded members until a sufficient fusedly coupled state thereof is obtained because of the reduced thickness of the welded portion of the leaf spring member 207 as the first member.

FIG. 21(*b*) shows the hardness distribution over a section of the leaf spring member as the first member, obtained as a result of welding performed in the method according to the invention. The measurement data was obtained with the diameter of the recesses 215 and 216 set to 0.6 mm. The bead width $h_1$ was 0.96 mm, and the measured width $H_1$ of the thermally influenced section was 1.2 mm, i.e., 0.6 mm to each end from the center in the direction of width. It will be seen that a hardness reduction due to thermal influence was produced in this range.

Figure 22A:
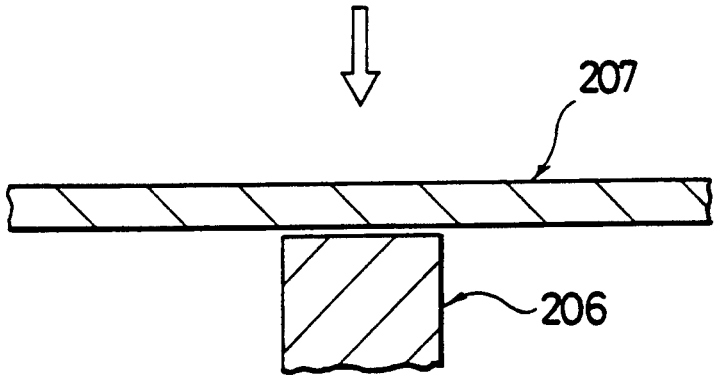
FIGS. 22(*a*) and 23(*al*) are views similar to FIG. 21(*a*) but for explaining examples of welding status in contrast to that according to the invention.
Figure 22B:
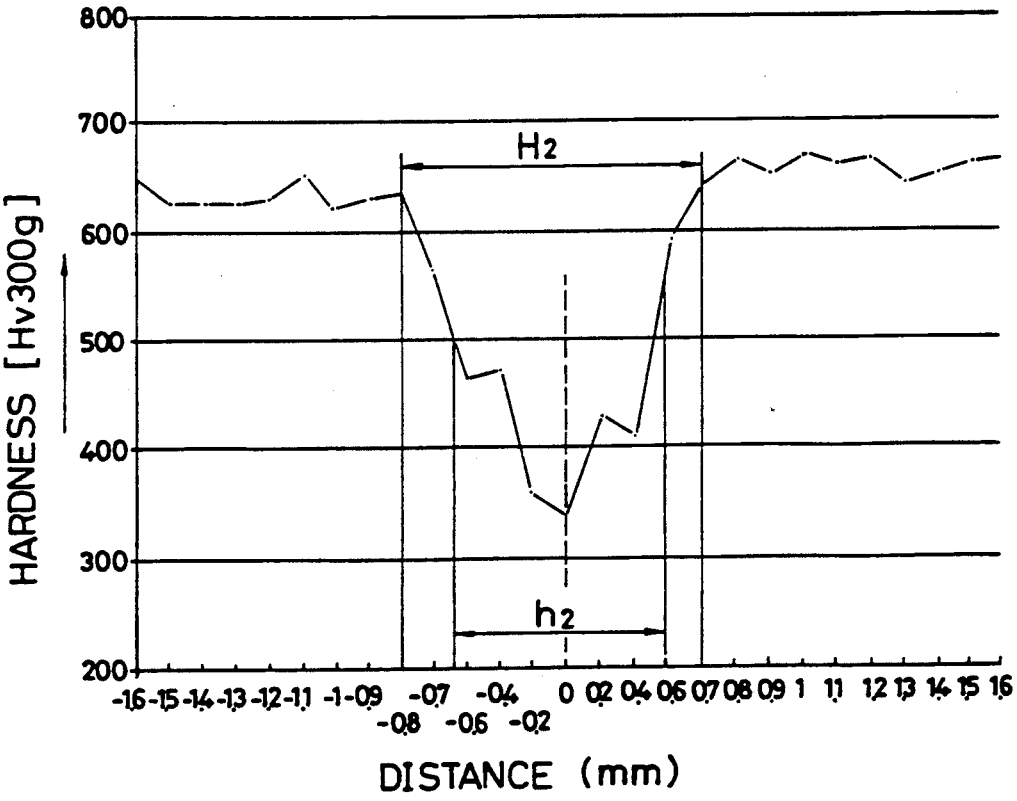

To evaluate the results of this embodiment, a leaf spring member 207 without any recess as the first member as shown in FIG. 22(*a*) is welded to armature member 206 as a second member in the same way with an electron beam as shown by the arrow. FIG. 22(*b*) shows a hardness distribution in this case. In this case, the bead width $h_2$ was 1.2 mm, and the width $H_2$ of the thermally influenced portion was 1.5 mm, i.e., 0.8 mm to the left and 0.7 mm to the right from the center in the width direction. It will be seen that hardness reduction due to thermal influence is produced. That is, the bead width and width of the thermally influenced portion were greater than those in the case of this embodiment.

Figure 23A:
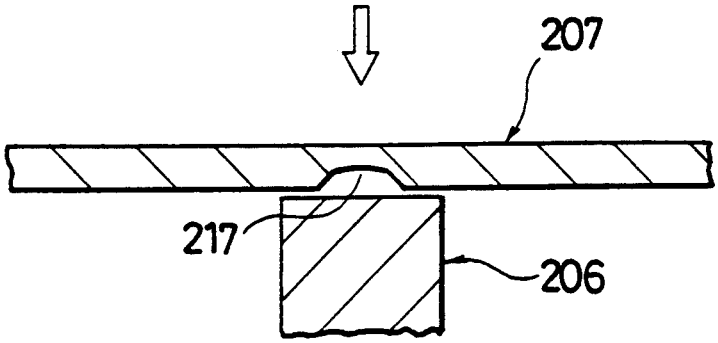
Figure 23B:
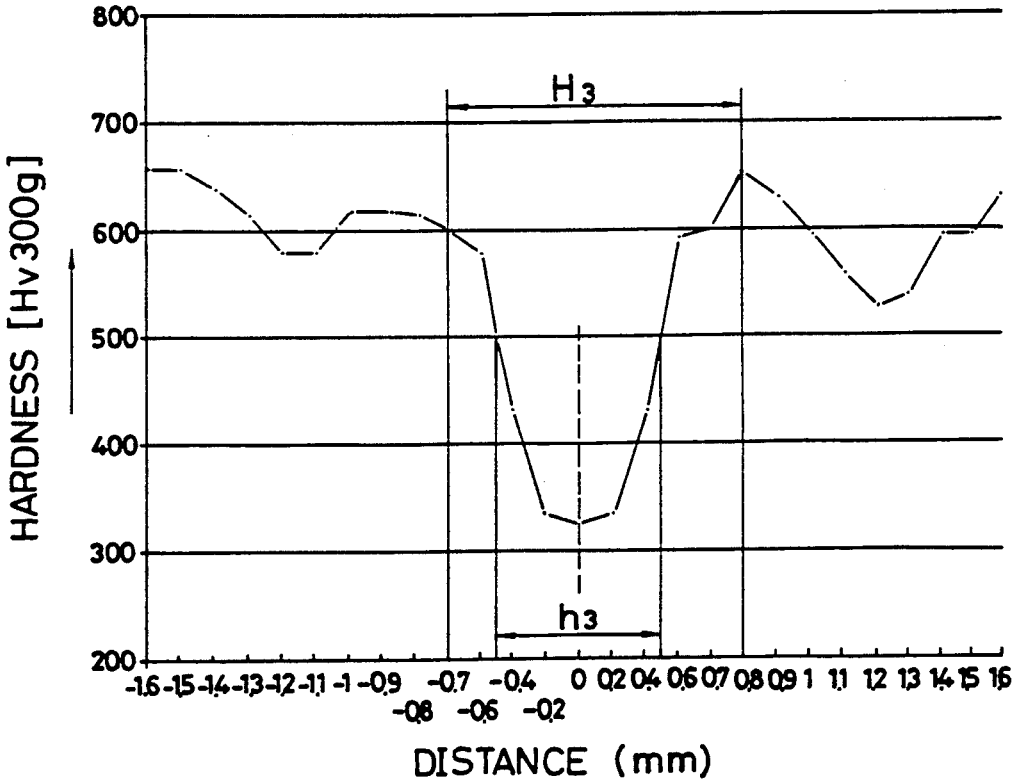

Further, for the sake of comparison with this embodiment leaf spring member 207 as a first member was formed on its surface to be welded facing the armature member with a recess 217 and welded to armature member 206 as a second member in the same way by irradiating with an electron beam as shown by the arrow. FIG. 23(*b*) shows a hardness distribution in this case. In this case, the bead width $h_3$ is 1.0 mm, close to the value in this embodiment. The width $H_3$ of the thermally influenced portion is 1.5 mm as a whole, indicating hardness reduction due to thermal influence in this range. In this case, with the recess 217 provided on the surface to be welded, a wide range is subject to thermal influence as in the case of FIG. 22(*a*) and 22(*b*) although the bead width is reduced, and the results that were obtained were not so satisfactory. Besides, a cavity is formed in the welded portions of the leaf spring member 207 and armature member 206. Therefore, the welding strength is liable to be insufficient compared to that in this embodiment.

As has been described in the foregoing, with the method of welding according to the invention, it is possible to reduce the spread of the bead width compared to the case of the prior art method and minimize the thermal influence on the edge portion. Thus, it is possible to obtain sufficient mechanical strength of the weldment. Further, where the leaf spring member 207 is used as the first member, it is possible to prevent the torsion bar portions and curved arm portions 210 of the leaf spring member 207 from becoming fragile.

Further, while in the above embodiments the first and second members to be welded together were a leaf spring member and armature member, respectively, the same method is applicable to other members as well.

It is to be understood that the present invention is not limited to the embodiments described above, and that various changes and modifications may be effected therein by one skilled in the art without departing from the scope or spirit of the invention.

What is claimed is:

1. A print head assembly of a printing device which performs printing on a printing medium in a printing position, comprising:

a head body including a plurality of cores arranged at a regular interval in a ring-like array, and solenoid coils individually wound around said respective cores and capable of generating magnetic forces when energized;

armature members individually facing said respective cores;

a supporting member supporting said armature members for swinging movement;

print wires individually operatively connected to said respective armature members;

guide means for guiding the print wires in movement thereof toward the printing medium;

a cover member for covering said array of armature members in a substantially parallel fashion thereto;

said print wires being moved selectively to a printing position upon selective energization of the associated solenoid coils, said supporting member being sandwiched along an axis between the head body and the cover member, said armature members being put on the supporting member on the side thereof opposite said guide means first aperture means formed in said cover member so as to face said armature members respectively; and first welding energy means applied to said supporting member and the armature members from the outside through said first aperture means, thereby to fix the supporting member and the armature members to one another.

2. The print head assembly according to claim 1, wherein said guide means includes a nose elongated along the axis, said cover member being formed integral with the nose such as to be connected to a proximal end portion thereof and extending substantially along a plane perpendicular to said axis.

3. The print head assembly according to claim 1, wherein said first welding energy means includes one of an electron beam and a laser beam.

4. The print head assembly according to claim 1, wherein said supporting member is formed of a leaf spring material which has a plurality of radially extending supporting pieces corresponding to said respective armature members and a ring-shaped portion integral with and supporting said supporting pieces such that said supporting pieces can be moved resiliently.

5. The print head assembly according to claim 4, further comprising a front yoke which is formed with a plurality of radially extending slits in which said armature members are located respectively; said front yoke being held together with said ring-shaped portion of the supporting member between the head body and the cover member; a magnetic path being formed by and extending through and around said front yoke, the armature members and the head body; second aperture means formed in said cover member so as to face said front yoke; and second welding energy means applied to the supporting member and the front yoke together from the outside through said second aperture means.

6. The print head assembly according to claim 5, further comprising a plate-like spacer; said front yoke, ring-shaped portion of the supporting member, spacer and cover member being held each other in the overlapped state in the mentioned order, whereby said front yoke, ring-shaped portion of the supporting member and spacer are fixed to each other by said welding energy supplied through said second aperture means.

7. The print head assembly according to claim 6, wherein said spacer has a plurality of through holes formed in its portion overlapped by said ring-shaped portion of the supporting member; said ring-shaped portion and the front yoke being fixed to each other by welding energy supplied through said through holes; said spacer and the ring-shaped portion being fixed to each other by welding energy supplied around said through holes.

8. The print head assembly according to claim 4, wherein each of said supporting pieces includes a torsion bar portion extending substantially perpendicular to the longitudinal direction of each corresponding armature member, a leaf spring portion extending parallel and offset to each corresponding armature member, and an armature-fixing portion to which the corresponding armature member is fixed in the overlapped state by the welding energy.

9. The print head assembly according claim 8, wherein said ring-shaped portion of the supporting member has an outer peripheral ring portion connected to an extended end of said torsion bar portion and an inner peripheral ring portion connected to a fixed end of said leaf spring portion and substantially concentric with said outer peripheral portion.

10. The print head assembly according to claim 9, further comprising a front yoke which is formed with a plurality of radially extending slits in which said armature members are located respectively; said front yoke being held together with said ring-shaped portion of the supporting member between the head body and the cover member; a magnetic path being formed by and extending through said front yoke, the armature member and the head body; said outer peripheral ring portion being secured to the outer periphery of said front yoke; said inner peripheral ring portion being secured to the inner end of said front yoke between adjacent ones of said slits.

11. The print head assembly according to claim 4, wherein each of said supporting pieces is formed with recess means on the side opposite thereof to said armature members, said welding energy for fixing the armature member and the corresponding supporting piece being supplied to said recess means.

12. The print head assembly according to claim 1, further comprising a plate-like permanent magnet member for biasing said armature members with its magnetic force against the resilient force of the supporting member, wherein the magnetic force of the solenoid coil selectively generated upon energization canceling the magnetic force of said permanent magnet member, thereby to allow the resilient force of the supporting member to move the corresponding armature member toward the printing position.

13. A print head assembly of a printing device which performs printing on a printing medium, comprising:

a head body including a plurality of cores arranged in a regular interval in a ring-like array and solenoid coils individually wound around said respective cores;

armature members individually facing said respective cores;

a leaf spring member having supporting pieces individually corresponding to said respective armature members and a ring-shaped portion supporting said supporting pieces such that said supporting pieces can be moved resiliently;

print wires individually operatively connected to said respective armature members;

a guide member for guiding the print wires in movement thereof toward the printing medium;

a front yoke having a plurality of slits in which said armature members are located respectively, a magnetic path being formed by and extending through said front yoke, the armature members, and the head body;

a cover member covering said array of armature members in a substantially parallel fashion thereto; and a plate-like spacer interposed between said cover member and leaf spring member, and in which said front yoke, leaf spring member and spacer are fixed to each other by welding;

said print wires being moved selectively to a printing position when the solenoid coils are energized selectively, said ring-shaped portion of the supporting member and the front yoke being interposed between the head body and the cover member along an axis, said armature members being put on the supporting member;

said supporting pieces of the leaf spring member and the corresponding armature members being fixed to one another by welding;

said front yoke and the ring-shaped portion of the supporting member being fixed to each other by welding;

said spacer has a plurality of through holes formed in the portion of the spacer which is overlapped by said ring-shaped portion of the supporting member, with a plurality of through holes;

said front yoke, leaf spring member and spacer being secured to one another by welding in their portions facing said through holes and edge portions surrounding said through holes.

14. A method of assembling a print head assembly, said print head assembly having a head body including a plurality of cores arranged at a regular interval in a ring-like array, and solenoid coils individually wound around said respective cores and capable of generating magnetic forces when energized; armature members individually facing said respective cores; a supporting member supporting said armature members for swinging movement; print wires individually operatively connected to said respective armature members; guide means for guiding the print wires in movement thereof toward the printing medium; a cover member for covering said array of armature members in a substantially parallel fashion thereto; said print wires being moved selectively to a printing position upon selective energization of the associated solenoid coils, said supporting member being sandwiched along an axis between the head body and the cover member, said armature members being put on the supporting member on the side thereof opposite said guide means first aperture means formed in said cover member so as to face said armature members respectively; and first welding energy means applied to said supporting member and the armature members from the outside through said first aperture means, thereby to fix the supporting member and the armature members to one another, said method comprising the steps of:

(a) overlapping said supporting member over said cover member;

(b) overlapping said armature members with said print wires connected thereto over said supporting member;

(c) securing together said supporting member and armature members by supplying welding energy through said first aperture means of said cover member; and (d) assembling said head body with solenoid coils wound on said cores to be integral with said supporting member, armature members and cover member.

15. The method of assembly according to claim 14, wherein said step (b) of overlapping said armature members over said cover member is performed after said print wires connected to said armature members have been inserted through said guide means.

16. The method of assembly according to claim 14, further comprising ,between said steps (b) and (c) ,a step (e) of overlapping over one another and securing together a front yoke having a plurality of radially extending slits and said supporting member, thereby locating said armature members in said respective slits and holding said front yoke together with said supporting member between said head body and cover member.

17. The method of assembly according to claim 16, further comprising ,between said steps (a) and (b), a step (f) of overlapping a plate-like spacer over said cover member and securing said plate-like space together with said cover members and front yoke to said cover member.

* * * * *